US006300849B1

(12) United States Patent
Takeda

(10) Patent No.: US 6,300,849 B1
(45) Date of Patent: Oct. 9, 2001

(54) DISTRIBUTED ELEMENT FILTER

(75) Inventor: Shigeki Takeda, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 09/449,582

(22) Filed: Nov. 29, 1999

(30) Foreign Application Priority Data

Nov. 27, 1998 (JP) ..... 10-337219
May 28, 1999 (JP) ..... 11-150150
Aug. 23, 1999 (JP) ..... 11-236068

(51) Int. Cl.[7] ..... H01P 1/20; H01P 7/06
(52) U.S. Cl. ..... 333/202; 333/230; 333/204
(58) Field of Search ..... 333/202, 203, 333/204, 206, 208, 230

(56) References Cited

U.S. PATENT DOCUMENTS 4,513,263 * 4/1985 Minnis ..... 333/204
5,576,672 * 11/1996 Hirai et al. ..... 333/204
5,841,330 * 11/1998 Wenzel et al. ..... 333/202
5,936,490 * 8/1999 Hershtig ..... 333/202

OTHER PUBLICATIONS

Synthesis and Realization of Narrow–Band Canonical Microwave Bandpass Filters Exhibiting Linear Phase and Transmission Zeros of Gerhard Pfitzenmaier, IEEE Transactions on Microwave Theory and Techniques, vol. MTT–30, No. 9, Sep. 1982.*

George L. Matthaei et la.; "Microwave filters, impedance matching networks, and coupling structures,"Artech House Books; 1980, pp. 586, 704 and 705.

Otto zinke et al.; "Erster Band Hochfrequenzfilter, Leitungen, Antennen"; Lehrbuch der Hochfrequenztechnik; Sprinter–Verlag; 1986; pp. 307–314.

Jia–Sheng Hong et al.; "On the Development of Superconducting Microstrip Filters for Mobile communications Applications"; IEEE Transactions on Microwave Theory and Techniques; vol. 47, No. 9; Sep. 1999; pp. 1656–16663.

Richard M. Kurzok, PE,; "Bridging Coupling Helps to Correct Amplitude Symmetry"; Applied Microwave & Wireless; Oct. 1999; pp. 38,40,42, and 44.

Fumiyasu Suginosita et al.,; "Elliptic Function Filters in a UHF–Band Transmitter for Digital Terrestrial Television Broadcasting"; Asia–Pacific Microwave Conference; 1998, pp. 169–172.

* cited by examiner

*Primary Examiner*—Robert Pascal
*Assistant Examiner*—Patricia T. Nguyen
(74) *Attorney, Agent, or Firm*—Hogan & Hartson, L.L.P.

(57) ABSTRACT

A distributed element filter is realized which has bandpass characteristics realizing both a flat amplitude characteristic and a flat group delay characteristic throughout the passband at the same time, while realizing transmission zeros in the stopbands. The transfer function s21 of a lowpass prototype filter is expressed by a numerator rational polynomial f(s) having at least one conjugate zeros on the real axis and one conjugate zeros on the imaginary axis and a denominator rational polynomial g(s) as a Hurwitz polynomial of degree 6 or higher; circuit blocks corresponding to the zeros on the real axis and zeros on the imaginary axis are each realized by a multiple resonator filter, and the distributed element filter is realized by a multiple coupling circuit block by setting the conditions on each coupling in corresponding relationship to the zeros on the real axis or zeros on the imaginary axis. The filter having the desired bandpass characteristics can thus be constructed and realized with simple circuitry by using a strict design procedure.

7 Claims, 16 Drawing Sheets

DISTRIBUTED ELEMENT FILTER

BACKGROUND OF THE INVENTION

1. Field of the Invention

The present invention relates to a distributed element filter used in the RF (radio frequency) stage, etc. of mobile communication equipment as a bandpass filter or the like to suppress noise and interfering signals, and more particularly to a distributed element filter which has a flat amplitude characteristic and a flat group delay characteristic in the passband, and transmission zeros in the stopbands, and is simplified in configuration in order to minimize losses for the purpose of improvement in performance.

2. Description of the Related Art

In high frequency circuit sections such as the RF stage of transmitter and receiver circuits for mobile communication equipment represented by analog or digital portable telephones or wireless telephones are often used bandpass filters (BPFs), for example, to attenuate harmonics which are caused by the nonlinearity of amplifier circuits, or to remove undesired signal waves such as interfering waves, sidebands, etc. from the desired signal waves, or when using the same antenna for both the transmitter and receiver circuits, to separate out the transmitter frequency band and the receiver frequency band.

Such bandpass filters for use in communication apparatuses are generally realized and constructed as filter circuits with desired bandpass characteristics by connecting series or parallel resonant circuits constructed with various circuit elements in a plurality of stages. Since the filter circuit blocks can be made smaller in size and have good electrical characteristics as high frequency circuits, in many cases circuit blocks are constructed using unbalanced distributed element transmission lines such as microstrip transmission lines or strip transmission lines. Generally, in a bandpass filter, as shown in FIGS. 24A, 24B, is required a complex circuit design to realize both a flat amplitude characteristic and a flat group delay characteristic, and at the same time, provide transmission zeros in the stopbands.

Procedures for directly synthesizing a bandpass filter having such characteristics based on a clear design theory have not been known as yet, and it has been practiced to construct filters empirically by using various known procedures. For example, as shown in a block diagram of FIG. 25, focusing first only on amplitude characteristics, such a filter 1 is designed from a filter of a known configuration, as has desired amplitude characteristics, namely, a flat amplitude characteristic throughout the passband and transmission zeros in the stopbands, but does not take the group delay characteristic into account yet. Next, in order that the filter 1 has a desired group delay characteristic as a whole, the filter 1 is provided with a phase equalizer 2 with all-pass characteristics, which has an effect of flattening the group delay characteristic in the passband. According to this procedure, the phase or group delay characteristic is improved by adding the phase equalizer 2 to the filter 1.

Such approach, however, has a disadvantage that the phase equalization or correction as shown in FIG. 25 has a limited effect and can not provide a sufficient equalization effect. Additionally, since the circuit design is wasteful requiring more circuit elements than would otherwise be required, the approach involves more difficulties than it solves, such as an adverse effect on the amplitude characteristic produced by the imperfect all-pass characteristics of the phase equalizer 2 and the increased loss produced by the increased complexity of the circuit.

Two procedures are well known in the art to realize transmission zeros in a filter's stopband. One is to realize transmission zeros by inserting a parallel resonator or series resonator in parallel or series in the filter or by combining these resonators. For example, as shown in the circuit diagram of FIG. 26, transmission zeros are formed on both sides of the passband by adding a combination 5 of a parallel resonator 5*a* and a series resonator 5*b* to a bandpass filter realized by resonators 3, 4.

The other procedure is to realize transmission zeros by splitting the transmission line into two paths which have the same output amplitude and differs from each other by 180° in phase, and combining the two paths together. For example, as shown in the block diagram of FIG. 27, the circuit is split into two paths which are led to a two-port 6 and a two-port 7, respectively, which provide at a certain frequency the same amplitude output and differ from each other by 180° in phase, and their outputs are combined to obtain an output which provides a transmission zero at that frequency.

Generally, the procedure of FIG. 27 can realize a filter with a circuit configuration easier to implement and smaller in loss than the procedure of FIG. 26 can.

Further, as a modification of FIG. 27, a procedure is known which uses a simple reactance feedback path. For this procedure, an accurate design theory or method for synthesizing the filter from the target circuit network function is not known, and an approximation or an empirical method is used. For example, as shown in the circuit diagram of FIG. 28, transmission zeros are formed by combining a filter block 8 as a conventional filter with a coupling element 9 corresponding to a branch circuit or feedback path. Because of circuit simplicity, this procedure has the effect of reducing the loss, but since no accurate design procedures are known for synthesizing the filter, the design relies on an approximation, which, therefore, has the problem that only approximate characteristics can be obtained and the obtained characteristics are not sufficient.

Another procedure known in the art is to combine a circuit of ladder structure with one of the above-described transmission zero forming procedures, and to thereafter adjust the group delay using a phase equalizer. According to this procedure, it is claimed that a filter with conventional bandpass characteristics can be obtained which has both a flat amplitude characteristic and a flat group delay characteristic throughout the passband and also has transmission zeros in the stopbands.

However, this procedure also has the problem that accurate characteristics cannot be obtained because the design relies on an approximation; furthermore, the circuit configuration becomes complex. Moreover, such filters have the problem that the transmission loss increases or only approximate and insufficient characteristics can be obtained. The problem of transmission loss is particularly pronounced when the filter is constructed of a distributed element filter such as a microstrip line circuit.

SUMMARY OF THE INVENTION

The present invention has been devised in view of the above-outlined problems of the prior art, and an object is to provide a distributed element filter which has bandpass characteristics realizing both a flat amplitude characteristic and a flat group delay characteristic throughout the passband at the same time, while realizing transmission zeros in the stopbands, and which has low element sensitivity and low losses and is capable of being constructed and realized with simple circuitry by a theoretically accurate design procedure.

In this specification, components, parts and elements which are designated in this specification by numerals and alphabetical subscripts attached thereto are often denoted by only the numerals without the alphabetical subscripts in general.

A first aspect of the invention provides a distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of the complex frequency s, the distributed element filter comprising:

a plurality of unit coupling circuits 83, 84 corresponding to the zeros on the real axis and the zeros on the imaginary axis, respectively, each of the unit coupling circuits 83, 84 including:

first and second resonators 19, 20;

a first coupling element 10 for connecting the first resonator 19 in cascade with a first external resonator 18 located outward of the first resonator 19;

a second coupling element 11 for connecting the first and second resonators 19, 20 in cascade;

a third coupling element 12 for connecting the second resonator 20 in cascade with a second external resonator 21 located outward of the second resonator 20; and a fourth coupling element 13 for bridge-coupling a connection point 85 between the first external resonator 18 and the first coupling element 10 with a connection point 86 between the third coupling element 12 and the second external resonator 21, wherein the plurality of unit coupling circuits 83, 84 are sequentially cascaded using the second external resonator 21 serving also as the first external resonator in the succeeding unit coupling circuit 84, the second and fourth coupling elements 11, 13 in the unit coupling circuit 83 corresponding to the zeros on the real axis are composed of, (a) reactive elements whose reactance values are the same in sign or (b) like coupling elements by either electric field coupling or magnetic field coupling, and the second and fourth coupling elements 15, 17 in the unit coupling circuit 94 corresponding to the zeros on the imaginary axis are composed of, (c) reactive elements whose reactance values are opposite in sign or (d) unlike coupling elements by one being of electric field coupling and the other being of magnetic field coupling.

The invention relates to a distributed element filter with bandpass characteristics, realized by an unbalanced distributed element circuit and obtained by frequency transforming a lowpass prototype filter whose transfer function s21 is expressed by a network function composed of a numerator rational polynomial, which is an even function of complex frequency s and has at least conjugate zeros on the real axis and at least conjugate zeros on the imaginary axis, and a denominator rational polynomial, which is a Hurwitz polynomial of the complex frequency s, wherein a circuit block corresponding to the zeros on the real axis or zeros on the imaginary axis of the numerator rational polynomial is realized by a multiple resonator filter having two or more unit coupling circuit blocks, each unit coupling circuit block comprising first and second resonators; a first coupling element for coupling the first resonator in cascade with a circuit located outward thereof; a second coupling element for coupling the first and second resonators in cascade; a third coupling element for coupling the second resonator in cascade with a circuit located outward thereof; and a fourth coupling element for bridge-coupling outward portions of the first coupling element and third coupling element, and wherein in the unit coupling circuit block corresponding to the zeros on the real axis, the second and fourth coupling elements are composed of, reactive elements of like sign or from like coupling portions by either electric field coupling or magnetic field coupling, and in the unit coupling circuit block corresponding to the zeros on the imaginary axis, the second and fourth coupling elements are composed of, reactive elements of unlike sign or from unlike coupling portions, one being of electric field coupling and the other being of magnetic field coupling.

According to the first aspect of the invention, a distributed element filter can be provided which has bandpass characteristics realizing both a flat amplitude characteristic and a flat group delay characteristic throughout the passband at the same time, while realizing transmission zeros in the stopbands, and which has low element sensitivity and low losses and is capable of being constructed and realized with simple circuitry using an accurate design procedure.

However, in the above-described filter, when the coupling elements in each unit coupling circuit block are realized by electric field coupling or magnetic field coupling, there arises a problem to be solved that weak coupling, other than the intended first coupling element, second coupling element, third coupling element, and fourth coupling element, is likely to occur between the resonators, resulting in degradation by unintended parasitic characteristic. For example, when the bandpass filter is constructed in accordance with the configuration as shown in FIG. 8 and described later in this specification, a coupling by electric field or magnetic field is likely to occur which tends to couple the resonator 33 with the third resonator 35 by jumping over the first resonator 34, that is, the magnetic field maximum points in the resonators 33, 35 are located opposite each other, and this tends to cause magnetic coupling. There is also the possibility that the electric field of the first coupling portion 25 may be coupled with the electric field of the second coupling portion 26. These tendencies are also likely to occur between the resonators 34, 35, 36, or the resonators 37, 38, 39, or the resonators 36, 37, 38.

For further improvement of the distributed element filter, it is desirable to suppress unintended coupling between these resonators and prevent parasitic characteristic degradation.

The present invention has been devised in view of the above outlined problem, and provides a distributed element filter which prevents characteristic degradation by suppressing unintended parasitic coupling between the resonators and, and which has low element sensitivity and low losses.

A second aspect of the invention provides a distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of the complex frequency s, the distributed element filter comprising:

a plurality of unit coupling circuits 183, 184 corresponding to the zeros on the real axis and the zeros on the imaginary axis, respectively, each of the unit coupling circuits 183, 184 including:

first and second resonators 19, 20;

a first coupling element 10 for connecting the first resonator 19 in cascade with a first external resonator 18 located outward of the first resonator 19;

a second coupling element 11 for connecting the first and second resonators 19, 20 in cascade;

a third coupling element 12 for connecting the second resonator 20 in cascade with a second external resonator 21 located outward of the second resonator 20; and a fourth coupling element 13 for bridge-coupling a connection point 85 between the first external resonator 18 and the first coupling element 10 with a connection point 86 between the third coupling element 12 and the second external resonator 21, wherein the plurality of unit coupling circuits 183, 184 are sequentially cascaded using the second external resonator 21 serving also as the first external resonator 18 in the succeeding unit coupling circuit 184, and in each of the unit coupling circuits 183, 184 the first and third coupling elements 10, 12 are both realized by one kind of coupling which is either electric field coupling or magnetic field coupling, the second coupling element 11 is realized by the other kind of coupling which is either electric field coupling or magnetic field coupling and is different from said one kind of coupling, the fourth coupling element 13 in the unit coupling circuit 183 corresponding to the zeros on the real axis is realized by said other kind of coupling which is either electric field coupling or magnetic field coupling, and the fourth coupling element 17 in the unit coupling circuit 184 corresponding to the zeros on the imaginary axis is realized by said one kind of coupling which is either electric field coupling or magnetic field coupling.

The invention relates to a distributed element filter with bandpass characteristics, realized by an unbalanced distributed element circuit and obtained by frequency transforming a lowpass prototype filter whose transfer function s21 is expressed by a network function composed of a numerator rational polynomial, which is an even function of complex frequency s and has at least conjugate zeros on the real axis and at least conjugate zeros on the imaginary axis, and a denominator rational polynomial, which is a Hurwitz polynomial of the complex frequency s, wherein a circuit block corresponding to the zeros on the real axis or zeros on the imaginary axis of the numerator rational polynomial is realized by a multiple resonator filter having two or more unit coupling circuit blocks, each unit coupling circuit block comprising first and second resonators; a first coupling element for coupling the first resonator in cascade with a circuit located outward thereof; a second coupling element for coupling the first and second resonators in cascade; a third coupling element for coupling the second resonator in cascade with a circuit located outward thereof; and a fourth coupling element for bridge-coupling outward portions of the first coupling element and third coupling element, and wherein the first coupling element and third coupling element are realized by like coupling which is either electric field coupling or magnetic field coupling, and the second coupling element is realized by electric field coupling or magnetic field coupling, whichever is different from said like coupling, in the unit coupling circuit block corresponding to the zeros on the real axis, the second coupling element and fourth coupling element are composed of, coupling elements of like coupling which is either electric field coupling or magnetic field coupling, and in the unit coupling circuit block corresponding to the zeros on the imaginary axis, the second coupling element and fourth coupling element are composed of, coupling elements of unlike coupling, one being of electric field coupling and the other being of magnetic field coupling.

According to the second aspect of the invention, a distributed element filter can be provided which has bandpass characteristics realizing both a flat amplitude characteristic and a flat group delay characteristic throughout the passband at the same time, while realizing transmission zeros in the stopbands, which is capable of being constructed and realized with simple circuitry using an accurate design procedure, and which has low element sensitivity and low losses by suppressing unintended coupling between the resonators and thereby preventing parasitic characteristic degradation.

In the first aspect of the invention, the inventor proposes a method for directly realizing a bandpass filter having the above-stated desired characteristics based on a clear design theory, and in the second invention, the inventor proposes a distributed element filter which has bandpass characteristics realizing both a flat amplitude characteristic and a flat group delay characteristic throughout the passband at the same time, while realizing transmission zeros in the stopbands, and which has low element sensitivity and low losses and is capable of being constructed and realized with simple circuitry using an accurate design procedure.

The proposal made in the second aspect of the invention requires the provision of at least 3.5 stages of resonators per conjugate zeros on the real or imaginary axis to realize each coupling element block corresponding to conjugate zeros on the real axis or conjugate zeros on the imaginary axis of the numerator rational polynomial. Since two 3.5-stage resonator circuits are connected in cascade to realize the coupling element blocks corresponding to the conjugate zeros on the real axis and conjugate zeros on the imaginary axis, respectively, seven or more stages of resonators must be provided. Furthermore, as the number of sets of conjugate zeros in the numerator rational polynomial increases, resonator stages must be provided in the quantity equal to an integral multiple, K, of 3.5, or the integer to which 3.5K is rounded, that is, at least four stages. This limits the number of zeros of the numerator rational polynomial which can be realized by the given number of resonators, imposing constraints on the realization of a filter having complex characteristics, and an improvement is needed on this point, The invention has been devised in view of the above problem, and provides a distributed element filter which enables the construction and realization of a circuit which is theoretically accurate, is simple in configuration, and provides improved performance by minimizing losses.

A third aspect of the invention provides a distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of degree 6 or higher of the complex frequency s, the distributed element circuit comprising:

a multiple coupling circuit block including:

first to fourth resonators 126 to 129;

a first coupling element 132 for connecting the first resonator 126 in cascade with a first external resonator 125 located outward of the first resonator 126;

a second coupling element 133 for connecting the first resonator 126 and the second resonator 127 in cascade;

a third coupling element 134 for connecting the second resonator 127 and the third resonator 128 in cascade;

a fourth coupling element 135 for connecting the third resonator 128 and the fourth resonator 129 in cascade;

a fifth coupling element 136 for connecting the fourth resonator 129 in cascade with a second external resonator 130 located outward of the fourth resonator 129;

a sixth coupling element 138 for bridge-coupling a connection point 208 between the first and second coupling elements 132, 133 and the first resonator 126 with a connection point 209 between the fourth and fifth coupling elements 135, 136 and the fourth resonator 129; and a seventh coupling element 139 for bridge-coupling a connection point 211 between the first coupling element 132 and the first external resonator 125 with a connection point 212 between the fifth coupling element 136 and the second external resonator 130, wherein of the first to seventh coupling elements, the sixth and seventh coupling elements are realized by electric field coupling, and of the first to fifth coupling elements, one or three coupling elements are realized by magnetic coupling and the others by electric field coupling.

A fourth aspect of the invention provides a distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of degree 6 or higher of the complex frequency s, the distributed element circuit comprising:

a multiple coupling circuit block including:

first to fourth resonators 126 to 129;

a first coupling element 132 for connecting the first resonator 126 in cascade with a first external resonator 125 located outward of the first resonator 126;

a second coupling element 133 for connecting the first resonator 126 and the second resonator 127 in cascade;

a third coupling element 134 for connecting the second resonator 127 and the third resonator 128 in cascade;

a fourth coupling element 135 for connecting the third resonator 128 and the fourth resonator 129 in cascade;

a fifth coupling element 136 for connecting the fourth resonator 129 in cascade with a second external resonator 130 located outward of the fourth resonator 129;

a sixth coupling element 138 for bridge-coupling a connection point 208 between the first and second coupling elements 132, 133 and the first resonator 126 with a connection point 209 between the fourth and fifth coupling elements 135, 136 and the fourth resonator 129; and a seventh coupling element 139 for bridge-coupling a connection point 211 between the first coupling element 132 and the first external resonator 125 with a connection point 212 between the fifth coupling element 136 and the second external resonator 130, wherein the sixth and seventh coupling elements are realized by magnetic field coupling, and of the first to fifth coupling elements, two or four coupling elements are realized by magnetic coupling and the others by electric field coupling.

A fifth aspect of the invention provides a distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of degree 6 or higher of the complex frequency s, the distributed element circuit comprising a multiple coupling circuit block including:

first to fourth resonators 126 to 129;

a first coupling element 132 for connecting the first resonator 126 in cascade with a first external resonator 125 located outward of the first resonator 126;

a second coupling element 133 for connecting the first resonator 126 and the second resonator 127 in cascade;

a third coupling element 134 for connecting the second resonator 127 and the third resonator 128 in cascade;

a fourth coupling element 135 for connecting the third resonator 128 and the fourth resonator 129 in cascade;

a fifth coupling element 136 for connecting the fourth resonator 129 in cascade with a second external resonator 130 located outward of the fourth resonator 129;

a sixth coupling element 138 for bridge-coupling a connection point 208 between the first and second coupling elements 132, 133 and the first resonator 126 with a connection point 209 between the fourth and fifth coupling elements 135, 136 and the fourth resonator 129; and a seventh coupling element 139 for bridge-coupling a connection point 211 between the first coupling element 132 and the first external resonator 125 with a connection point 212 between the fifth coupling element 136 and the second external resonator 130, wherein the sixth coupling element is realized by electric field coupling and the seventh coupling element by magnetic field coupling, and of the first to fifth coupling elements, zero or two or four coupling elements are realized by magnetic coupling and the others by electric field coupling.

A sixth aspect of the invention provides a distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of degree 6 or higher of the complex frequency s, the distributed element circuit comprising:

a multiple coupling circuit block including:

first to fourth resonators 126 to 129;

a first coupling element 132 for connecting the first resonator 126 in cascade with a first external resonator 125 located outward of the first resonator 126;

a second coupling element 133 for connecting the first resonator 126 and the second resonator 127 in cascade;

a third coupling element 134 for connecting the second resonator 127 and the third resonator 128 in cascade;

a fourth coupling element 135 for connecting the third resonator 128 and the fourth resonator 129 in cascade;

a fifth coupling element 136 for connecting the fourth resonator 129 in cascade with a second external resonator 130 located outward of the fourth resonator 129;

a sixth coupling element 138 for bridge-coupling a connection point 208 between the first and second coupling elements 132, 133 and the first resonator 126 with a connection point 209 between the fourth and fifth coupling elements 135, 136 and the fourth resonator 129; and a seventh coupling element 139 for bridge-coupling a connection point 211 between the first coupling element 132 and the first external resonator 125 with a connection point 212 between the fifth coupling element 136 and the second external resonator 130, wherein the sixth coupling element is realized by magnetic field coupling and the seventh coupling element by electric field coupling, and of the first to fifth coupling elements, one or three or five coupling elements are realized by magnetic coupling and the others by electric field coupling.

The invention relates to a distributed element filter with bandpass characteristics, realized by an unbalanced distributed element circuit and obtained by frequency transforming a lowpass prototype filter whose transfer function s21 is expressed by a network function composed of a numerator rational polynomial, which is an even function of complex frequency s and has at least conjugate zeros on the real axis and at least conjugate zeros on the imaginary axis, and a denominator rational polynomial, which is a Hurwitz polynomial of degree 6 or higher of the complex frequency s, wherein a circuit block corresponding to the conjugate zeros on the real axis and conjugate zeros on the imaginary axis of the numerator rational polynomial and to the denominator rational polynomial corresponding thereto is realized by a multiple resonator filter having one or more multiple coupling circuit blocks, each multiple coupling circuit block comprising: first to fourth resonators; a first coupling element for coupling the first resonator in cascade with a circuit located outward thereof; a second coupling element for coupling the first resonator and the second resonator in cascade; a third coupling element for coupling the second resonator and the third resonator in cascade; a fourth coupling element for coupling the third resonator and the fourth resonator in cascade; a fifth coupling element for coupling the fourth resonator in cascade with a circuit located outward thereof; a sixth coupling element for bridge-coupling outward portions of the second coupling element and fourth coupling element; and a seventh coupling element for bridge-coupling outward portions of the first coupling element and fifth coupling element, and wherein the first to seventh coupling elements are realized in one of the following A to D combinations of electric field coupling versus magnetic field coupling:

A: the sixth and seventh coupling elements are realized by electric field coupling and, of the first to fifth coupling elements, one or three coupling elements are realized by magnetic field coupling and the others by electric field coupling;

B: the sixth and seventh coupling elements are realized by magnetic field coupling and, of the first to fifth coupling elements, two or four coupling elements are realized by magnetic field coupling and the others by electric field coupling;

C: the sixth coupling element is realized by electric field coupling and the seventh coupling element by magnetic field coupling and, of the first to fifth coupling elements, zero or two or four coupling elements are realized by magnetic field coupling and the others by electric field coupling; and D: the sixth coupling element is realized by magnetic field coupling and the seventh coupling element by electric field coupling and, of the first to fifth coupling elements, one or three or five coupling elements are realized by magnetic field coupling and the others by electric field coupling.

According to the fourth to sixth aspects of the invention, a distributed element filter can be provided which has bandpass characteristics realizing both a flat amplitude characteristic and a flat group delay characteristic throughout the passband at the same time, while realizing transmission zeros in the stopbands, which is capable of being constructed and realized with simple circuitry using an accurate design procedure and without design constraints in the realization of a filter having complex characteristics, and which has low element sensitivity and low losses.

In the invention it is preferable that the distributed element filter has bandpass characteristics realizing both a flat amplitude characteristic and a flat group delay characteristic throughout a passband thereof at the same time, while realizing transmission zeros in stopbands thereof.

In the invention it is preferable that the multiple resonator filter is composed of distributed element circuit elements formed as a conductive pattern on a dielectric substrate.

Further, in the invention it is preferable that the first and second external resonators 18, 21 ; 125, 130 are parallel circuits or series circuits having an inductor and a capacitor.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
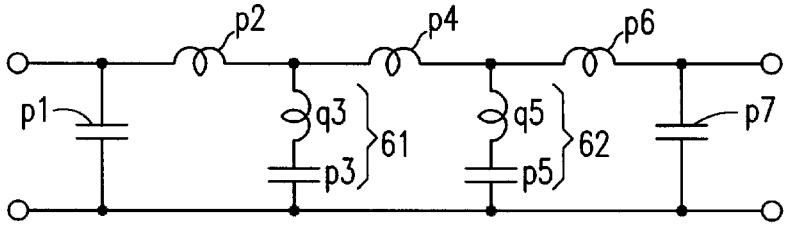
FIG. 1 is a circuit diagram showing an example of a lowpass prototype filter according to the invention.

Now referring to the drawings, preferred embodiments of the invention are described below.

A distributed element filter of a first embodiment shown in FIGS. 1 to 8 and 23, according to the invention, comprises a plurality of unit coupling circuits 83, 84 corresponding respectively to the zeros on the real axis and zeros on the imaginary axis of the equation "numerator rational polynomial f(s)=0", the numerator rational polynomial f(s) forming part of the transfer function s21, and the unit coupling circuits 83, 84 include a plurality of resonators 18 to 21 and 22 to 24, respectively. Since the distributed element filter is realized by a multiple resonator filter having two or more unit coupling circuits, as described, a circuit with improved performance can be constructed and realized in a theoretically strictly manner by minimizing losses while simplifying the configuration of the filter.

Here, the degree n1 of the numerator rational polynomial f(s) is 4 or higher ($n1 \geqq 4$) having at least conjugate zeros on the real axis and at least conjugate zeros on the imaginary axis, and the respective zero pairs are assigned for the formation of the respective unit coupling circuits 83, 84. The degree m1 of the denominator rational polynomial, a Hurwitz polynomial, is higher than the degree nl of the numerator rational polynomial by degree 3 or more ($n1+3 \leqq m1$), and degree 3 or 4 or higher degree is assigned for the formation of the respective unit coupling circuits 83, 84.

(1) The conjugate zeros on the imaginary axis of the numerator rational polynomial is assigned for the formation of the unit coupling circuit 84 in which the second coupling element 15 and fourth coupling element 17 are composed of, reactive elements of unlike sign or from unlike coupling, one being of electric field coupling and the other being of magnetic field coupling. (2) Likewise, the conjugate zeros on the real axis of the numerator rational polynomial is assigned for the formation of the unit coupling circuit 83 in which the second coupling element 11 and fourth coupling element 13 are composed of, reactive elements of like sign or from like coupling which is either electric field coupling or magnetic field coupling.

The distributed element filter of the invention is realized by a microstrip circuit which is an unbalanced distributed element circuit, but the fourth coupling elements 13, 17 in the respective unit coupling circuits 83, 84 can also be realized, for example, by (1) lumped reactive elements or (2-1) the coupling between the electric field and the electric charge on the resonators at both ends or the unit coupling circuits 83, 84 or (2-2) the coupling between the magnetic field and the current there.

The transfer function s21 used for the realization of the distributed element filter of the invention is the transfer function s21 at a lowpass prototype filterstage and is expressed by a network function composed of a numerator rational polynomial, which is an even function of complex frequency s and has at least conjugate zeros on the real axis and at least conjugate zeros on the imaginary axis, and a denominator rational polynomial, which is a Hurwitz polynomial of the complex frequency s. Thereby flat amplitude characteristics throughout the passband can be obtained which is flattened by the conjugate zeros on the real axis of the numerator rational polynomial. Further, attenuation poles, transmission zeros whose frequencies are determined by the conjugate zeros on the imaginary axis, can be formed near the filter passband. Accordingly, a filter with passband characteristics achieving sufficiently minimized insertion losses in the passband by the presence of the transmission zeros can be obtained while at the same time, achieving the desired flat amplitude and flat group delay characteristics by imposing independent conditions on the amplitude and phase characteristics in the filter passband.

Since an ideal transformer and a gyrators, as well as a series resonant circuit and a parallel resonant circuit, can be easily realized using an unbalanced distributed element circuit such as a microstrip circuit, a distributed element filter simple in configuration and having the above-described desired characteristics can be constructed of an unbalanced distributed element circuit.

To realize the distributed element filter of the invention, first a phase characteristic is determined for the given specifications defining the characteristics of the lowpass prototype filter, using the denominator rational polynomial, a Hurwitz polynomial, which has a linear phase characteristic. Next, the zeros on the imaginary axis of the numerator rational polynomial, an even function of the complex frequency s, are specified so that transmission zeros are provided at specified frequencies, and additionally the zeros on the real axis of the numerator rational polynomial are set so that the amplitude characteristic becomes flat throughout the passband.

Next, deriving the remainder network function from the transfer function s21, composed of the above numerator rational polynomial and denominator rational polynomial, the lowpass prototype filter whose transfer function is the transfer function s21 is synthesized.

Next, elements having negative capacitance or negative inductance values are transformed by equivalent transforming to elements having actually existing positive capacitance or positive inductance values, and after frequency transformation to an equivalent bandpass filter, the lowpass prototype filter is finally transformed to an unbalanced constant circuit.

A distributed element filter of the invention will be described in detail below.

Figure 9:
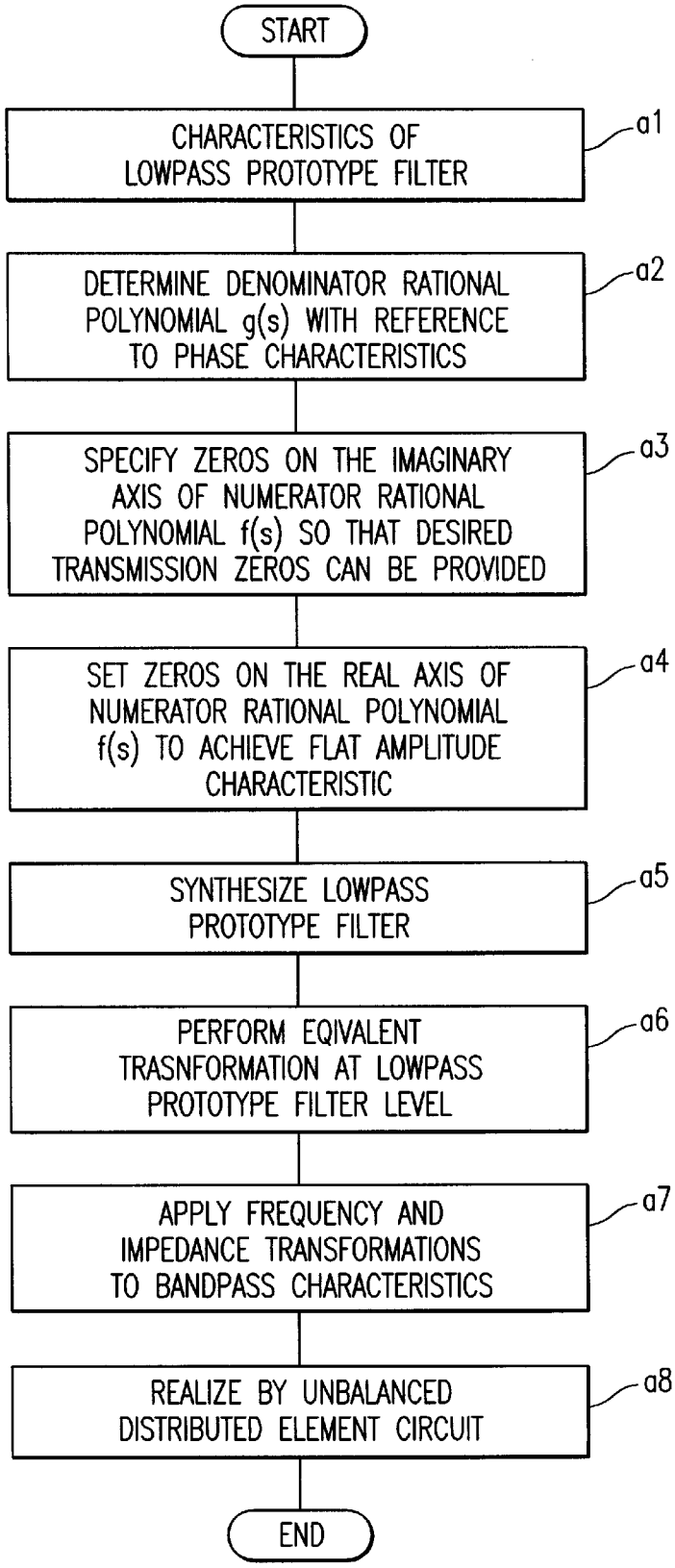
FIG. 9 is a diagram showing a design procedure for the distributed element filter.

Referring to FIG. 9 illustrating the design procedure for the lowest order realization of the distributed element filter of the invention, in step a1 the numerator rational polynomial is set as a polynomial f(s) of degree 4 having one conjugate zeros on the real axis and one conjugate zeros on the imaginary axis, and the denominator rational polynomial as a Hurwitz polynomial g(s) of degree 7; then the network function for s21 is expressed as a function of the complex frequency $$s = \sigma + j\omega \tag{1}$$

$$s21 = \frac{f(s)}{g(s)} = \frac{b_4 s^4 + b_2 s^2 + b_0}{a_7 s^7 + a_6 s^6 + a_5 s^5 + a_4 s^4 + a_3 s^3 + a_2 s^2 + a_1 s + a_0}$$

Here, the denominator rational polynomial g(s) is a polynomial, for example, a Bessel polynomial, which provides a flat group delay characteristic.

Next, in step a2, the amplitude characteristic of the denominator rational polynomial g(s) is adjusted by the choice of numerator rational polynomial f(s) without adversely affecting the group delay characteristic, and in step a3, transmission zeros are provided in the stopband by using the conjugate zeros on the imaginary axis of the numerator rational polynomial f(s). Further, in step a4, the amplitude characteristic is flattened using the conjugate zeros on the real axis of the numerator rational polynomial so that the amplitude characteristic is made as flat as possible throughout the passband. In this way, the numerator rational polynomial is determined in accordance with the denominator rational polynomial and the target filter characteristics.

In step a5, the lowpass prototype filter as illustrated in the circuit diagram of FIG. 1 is determined from the thus determined polynomials f(s) and g(s). In this lowpass prototype filter, the number of stages of two-terminal circuit elements connected in parallel or series in a ladder configuration corresponds to the degree of the Hurwitz polynomial which, in the illustrated example, is 7. Two series resonant circuits 61, 62 connected in parallel are circuit blocks corresponding respectively to the conjugate zeros on the real axis and those on the imaginary axis of the numerator rational polynomial f(s).

Of the circuit blocks 61, 62 corresponding to the conjugate zeros on the real axis and the conjugate zeros on the imaginary axis, respectively, the circuit elements forming the series resonant circuit corresponding to the conjugate zeros on the imaginary axis have positive capacitance or inductance values and are therefore realizable in an existing circuit. On the other hand, the circuit element which forms the series resonant circuit corresponding to the conjugate zeros on the real axis is an element in which either a capacitance or an inductance has a negative value, and this resonant circuit cannot be realized directly in a practical circuit.

Figure 10:
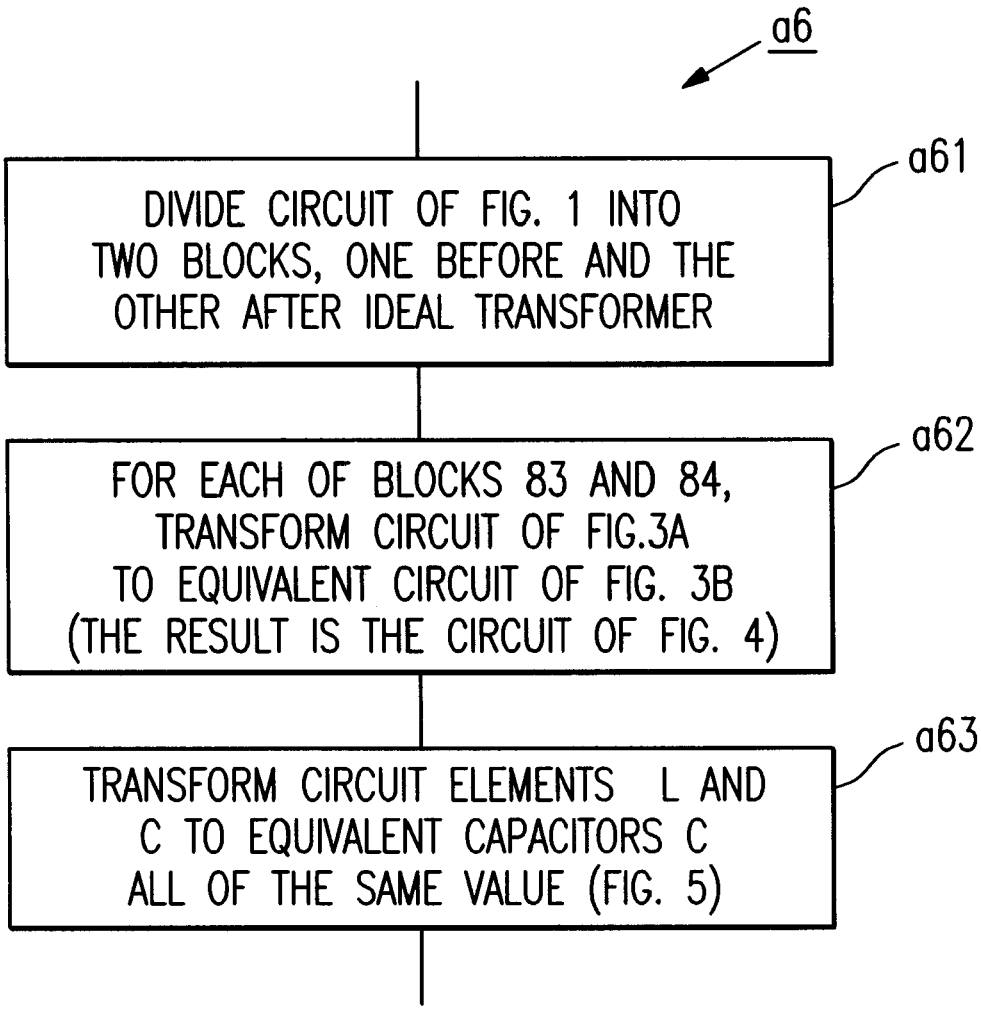
FIG. 10 is a diagram for explaining details of the design procedure executed in step a6 of FIG. 9.

Accordingly, in the next step a6, an equivalent transformation is performed to form the unit coupling circuits 83, 84. That is, the circuit shown in FIG. 1 is transformed to the equivalent circuit shown in FIG. 2 by using imaginary gyrators 64, 65. FIG. 10 shows the detail design procedure of step a6 in FIG. 9. In step a61 of FIG. 10, the circuit shown in FIG. 2 is divided into two blocks 83, 84, one before and the other after an ideal transformer 66 as viewed in the direction of signal flow.

Figure 2:
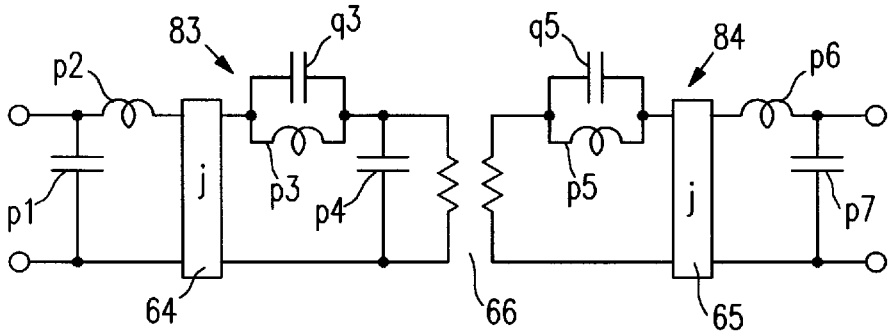
FIG. 2 is a circuit diagram showing an example of an equivalently transformed lowpass prototype filter according to the invention.
Figure 3A:
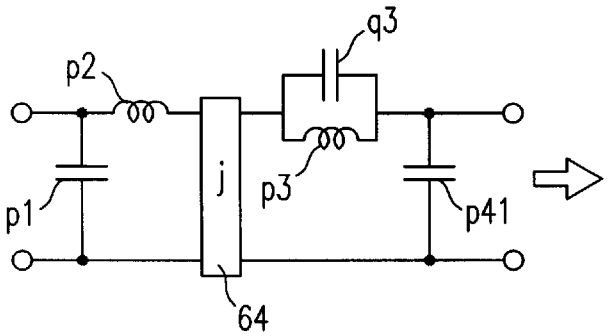
FIGS. 3A, 3B are circuit diagrams showing an example of the equivalent transformation of a unit coupling circuit in the lowpass prototype filter according to the invention.
Figure 3B:
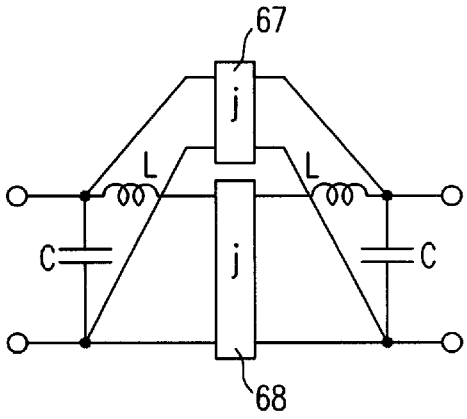

In step a62, first focusing attention on the circuit block 83 in the left-hand side of FIG. 2, a circuit such as shown in FIG. 3A is considered. Then, for this circuit, a circuit containing two imaginary gyrators 67, 68, as shown in FIG. 3B, is considered; it can then be seen that by suitably replacing the parameters of the circuits of FIGS. 3A, 3B, both circuits become equivalent. The circuit element p4 in FIG. 2 is replaced by the circuit element p41 in the circuit of FIG. 3A. L and C in FIG. 3B indicate that the designated circuit elements are inductors and capacitors, respectively, and their values may differ from each other. Likewise, the gyrators 67, 68 are indicated by j, and their values may differ from each other. The same thing applies for the diagrams hereinafter given.

Figure 4:
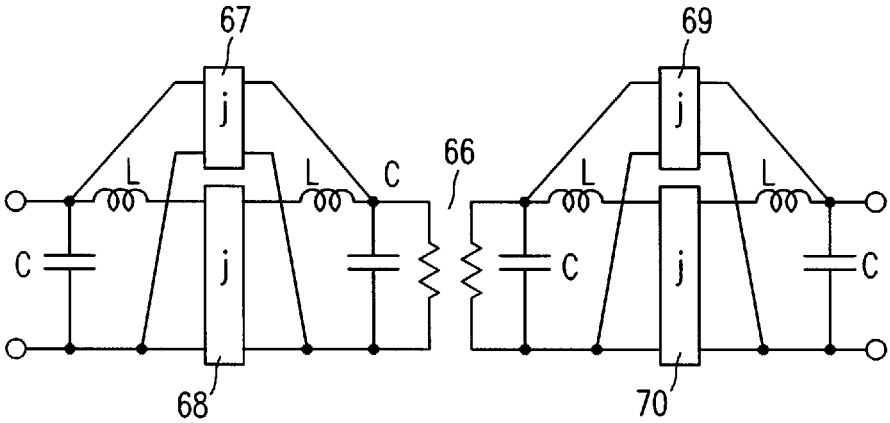
FIG. 4 is a circuit diagram showing an example of the equivalently transformed lowpass prototype filter according to the invention.

Next, focusing attention on the circuit block 84 in the right-hand side of FIG. 2, the above process is repeated to obtain the equivalent circuit of FIG. 4 containing gyrators 69, 70. In this way, the lowpass prototype filter shown in FIG. 1 is transformed through the equivalent transformations of FIGS. 2, 3 into the equivalent lowpass prototype filter shown in FIG. 4.

In step a63, imaginary gyrators 71 to 74 and 75 to 78 and ideal transformers 79, 80 are introduced in the equivalent lowpass prototype filter shown in FIG. 4 to transform the circuit elements L and C to equivalent capacitors C arranged in parallel and all having the same value. The result is the equivalent lowpass prototype filter shown in FIG. 5, which is strictly and exactly equivalent to the lowpass prototype filter shown in FIG. 1.

Figure 5:
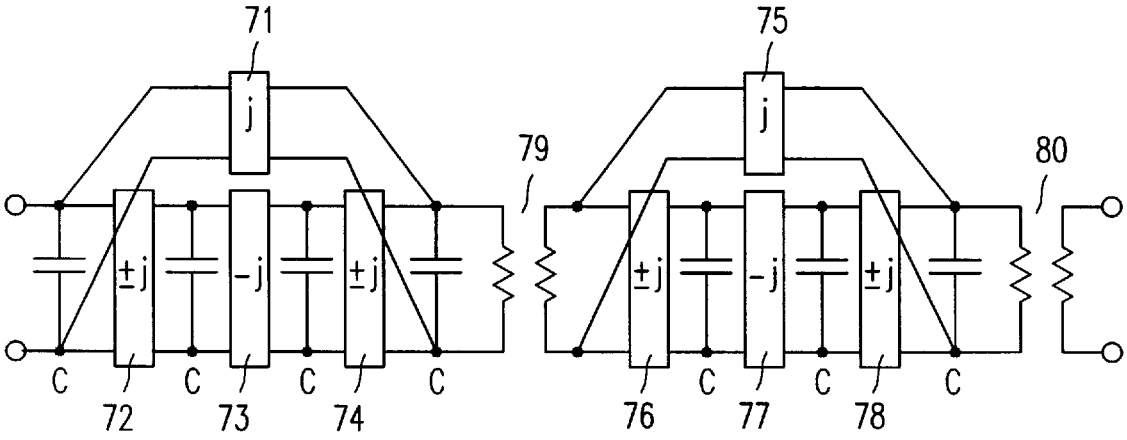
FIG. 5 is a circuit diagram showing an example of the equivalently transformed lowpass prototype filter according to the invention.
Figure 6:
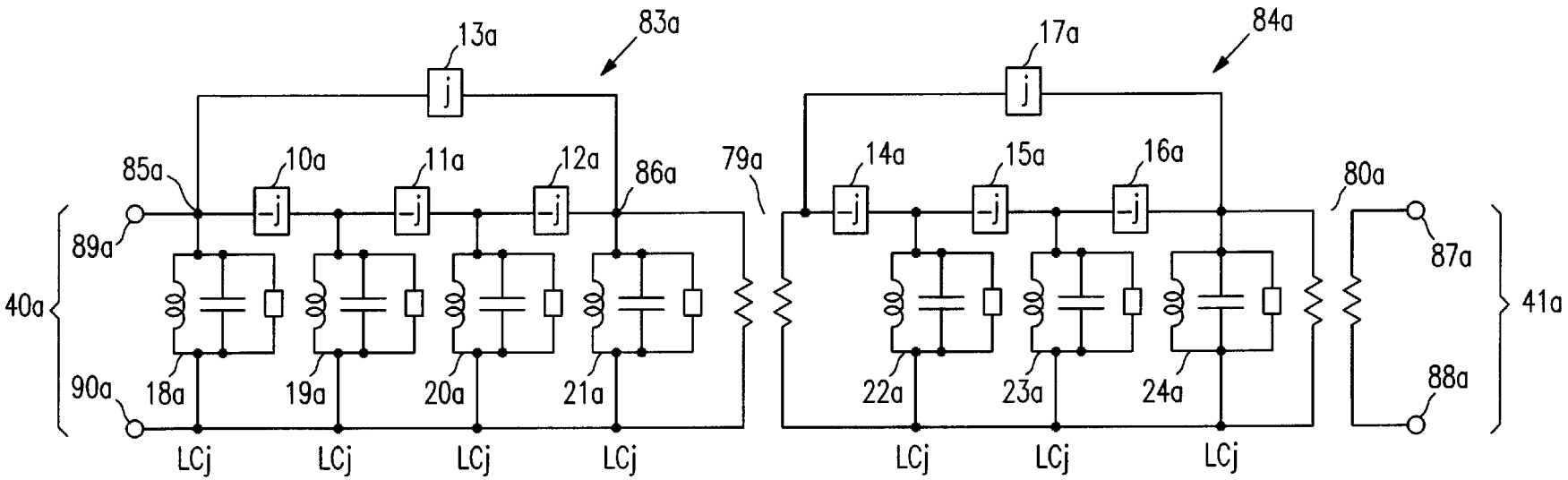
FIG. 6 is a circuit diagram showing an example of transformation to a bandpass filter according to the invention.

Next, in step a7 of FIG. 9, this lowpass prototype filter is subjected to frequency transformation and impedance transformation in order to transform the element value to a reasonable value, and transformed to the bandpass filter having the target bandpass characteristics. Here, the impedance transformation is performed for impedance matching with external circuits. At this time, the capacitors C in the circuit of FIG. 5 are transformed to parallel resonant circuits as the result of the frequency transformation, but the imaginary gyrators 71 to 78 remain unchanged. Then, when the imaginary gyrators 71 to 78 are implemented by $\pi$-type connections of constant reactive elements having reactance not dependent on frequency, the target bandpass filter of the circuit configuration shown in FIG. 6 is realized. The constant reactive elements of the coupling elements 10 to 13 and 14 to 17 can each be realized by capacitive or electric field coupling or inductive or magnetic field coupling, using a narrowband approximation around the passband. By the narrowband approximation is configured approximately a constant reactive element having a positive or negative reactance at a frequency around the passband, using a capacitor in the case of a negative reactance or an inductor in the case of a positive reactance.

Next, in step a8, attention is directed to the circuit 83*a* to the left of the ideal transformer 79*a* at the center of FIG. 6. The four coupling elements in FIG. 6, i.e., the constant reactive elements 10*a*, 11*a*, 12*a*, 13*a*, and the four resonant circuits (resonators) 18*a*, 19*a*, 20*a*, 21*a* together constitute one unit coupling circuit 83*a*. The circuit 83*a* in FIG. 6 comprises: (a) the first coupling element 10*a* for coupling the first resonator 19*a* in cascade with the resonator 18*a* located outward thereof and connected to the terminals 45*a*, 46*a* of the first resonator 19*a*; (b) the second coupling element 11*a* for coupling the first resonator 19*a* and the second resonator 20*a* in cascade; (c) the third coupling element 12*a* for coupling the second resonator 20*a* with the resonator 21*a* located outward thereof (in the left side of FIG. 6); and (d) the fourth coupling element 13*a* for bridge-coupling the connection points 85*a*, 86*a* located outward of the first coupling element 10*a* and third coupling element 12*a* (at the left and right in FIG. 6). The constant reactive elements of the coupling elements 10*a* to 13*a* can be of any sign, but the condition hereinafter described is imposed on the relationship between the signs of the second coupling element 11*a* and the fourth coupling element 13*a*, according to whether the zeros of the numerator rational polynomial f(s) are zeros on the real axis or zeros on the imaginary axis. The resonators 18*a*, 21*a* are similar in configuration to the resonators 19*a*, 20*a*, and these resonators 18*a*, 19*a*, 20*a*, 21*a* may have the same configuration. The other unit coupling circuit 84*a* is similar in configuration to the above-described unit coupling circuit 83*a*, and in the unit coupling circuit 84*a*, the resonator 21*a* located in the second outermost resonator of the unit coupling circuit 83*a* (in the left side of FIG. 7) is used, which resonator 21*a* serves also as the first external resonator to which the first coupling element 14*a* is connected; in this way, the unit coupling circuit 84*a* also comprises the four resonators 21*a* to 24*a*, just as the unit coupling circuit 83*a* comprises the four resonators 18*a* to 21*a*. Thus the plurality of unit coupling circuits 83*a*, 84*a* are sequentially connected in cascade.

With respect to reference characters in this specification, the same numerals designate components, parts and elements having like or corresponding configurations, while they are often designated by numerals and alphabetical subscripts attached thereto. In general they are designated by only the numerals without the alphabetical subscripts.

More specifically, (1) when the circuit elements q3, p3 and q5, p5 of the series resonant circuits 61 and 62 connected in parallel in the lowpass prototype filter in FIG. 1 both have positive reactance values, that is, when the circuit elements correspond to the conjugate zeros on the imaginary axis of the numerator rational polynomial f(s), the second coupling element 11*a* and fourth coupling element 13*a* are opposite in sign to each other, that is, unlike sign. As a result, (1-1) either one of the coupling elements (11*a* or 13*a*) is realized by capacitive coupling or electric field coupling, while on the other hand (1-2) the other coupling element (13*a* or 11*a*) is realized by inductive coupling or magnetic field coupling, the two coupling elements 11*a*, 13*a* thus being realized by unlike coupling. Thereby transmission zeros are formed at the unit coupling circuit.

On the other hand, (2) when the circuit elements of the series resonant circuits 61, 62 connected in parallel in the lowpass prototype filter in FIG. 1 have reactance values opposite in sign to each other, one having a positive value and the other a negative value, that is, when the circuit elements correspond to the conjugate zeros on the real axis of the numerator rational polynomial f(s), the second coupling element 11*a* and fourth coupling element 13*a* are the same in sign, that is, like sign. As a result, both circuit 11*a*, 13*a* are realized by either (2-1) capacitive coupling or electric field coupling or (2-2) inductive coupling or magnetic field coupling, i.e., like coupling. Thereby the amplitude characteristic in the passband is adjusted flat at the unit coupling circuit.

Next, attention is directed to the circuit 84*a* to the right of the ideal transformer 79*a* at the center of FIG. 6. As shown in FIG. 6, the circuit 84*a* at the right comprises the first coupling element 14*a*, second coupling element 15*a*, third coupling element 16*a*, and fourth coupling element 17*a*. The circuit at the right can be treated exactly the same as the circuit at the left of the ideal transformer 79*a*. In this case the resonator 21*a* is an external resonator of the first resonator 22*a*.

For example, the circuit 83*a* to the left of the ideal transformer 79*a* is made to correspond to the conjugate zeros on the real axis of the numerator rational polynomial f(s), and the circuit 84*a* to the right is made to correspond to the conjugate zeros on the imaginary axis of the numerator rational polynomial f(s). Further, for ease of circuit realization, the coupling elements 10*a* to 13*a* and 14*a* to 17*a* are configured to have reactance of the same sign and realized by capacitive coupling or electric field coupling as far as possible. In that case, all the coupling elements 10*a* to 17*a*, except the fourth coupling element 17*a*, are realized by capacitive coupling (or electric field coupling), and only the fourth coupling element 17*a* is realized by inductive coupling (or magnetic field coupling).

Figure 7:
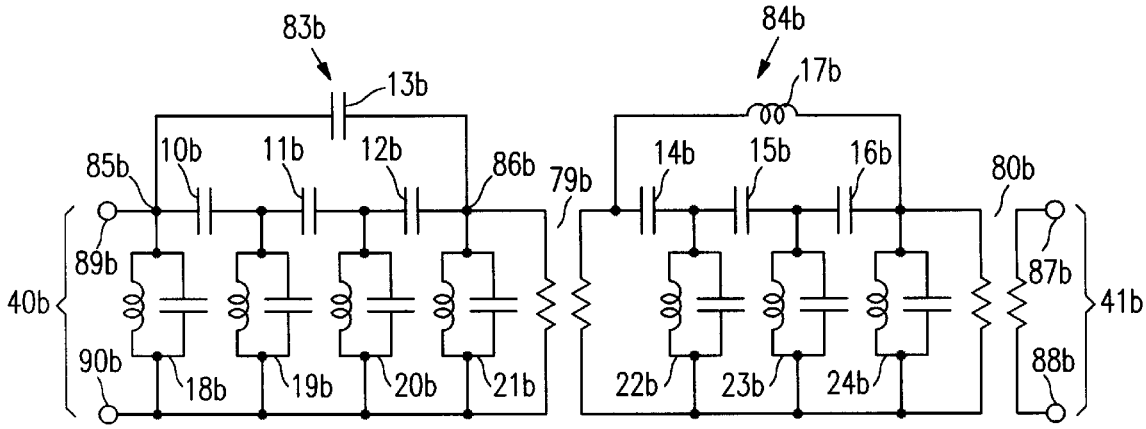
FIG. 7 is an equivalent circuit diagram showing an embodiment of the bandpass filter according to the invention.

FIG. 7 shows an equivalent circuit diagram for the embodiment of the bandpass filter circuit obtained as the result of the above narrowband approximation.

Figure 8:
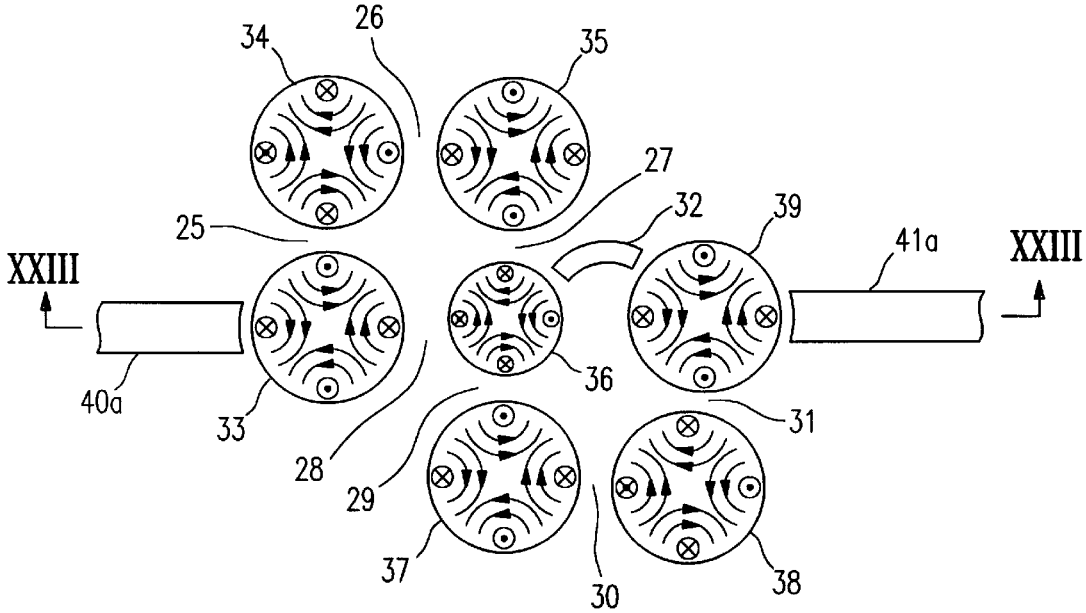
FIG. 8 is a plan view showing a configuration example when the embodiment of the bandpass filter of FIG. 7 is realized by a distributed element filter.

FIG. 8 is a plan view showing a configuration example of the distributed element filter of the invention as implemented in the narrowband approximated embodiment shown in FIG. 7.

Figure 23:
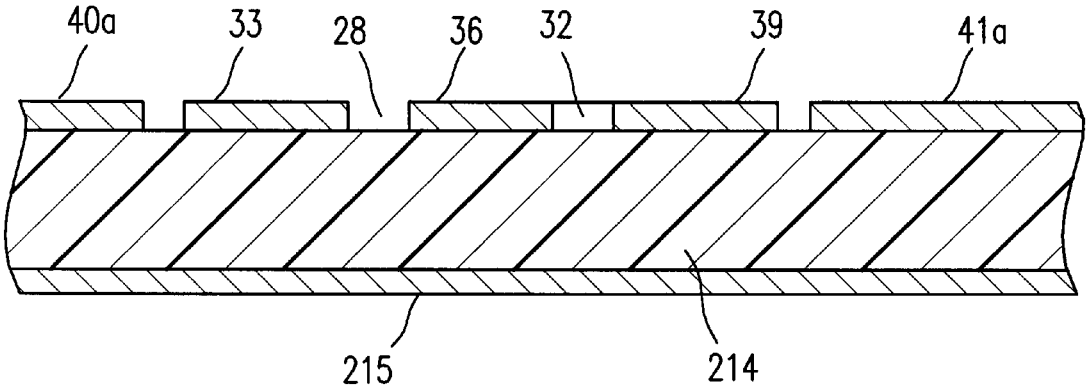
FIG. 23 is a cross sectional view taken along cutting plane XXIII—XXIII in FIG. 8.
Figure 24A:
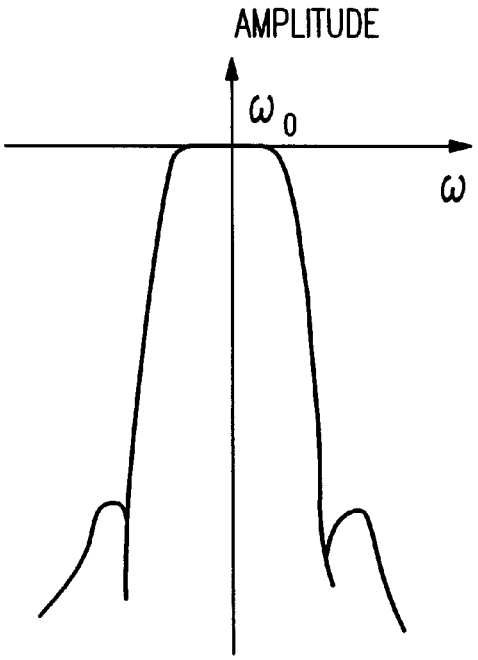
FIGS. 24A, 24B are diagrams showing amplitude characteristics s21 and group delay characteristics of a passband filter of the invention, respectively.
Figure 24B:
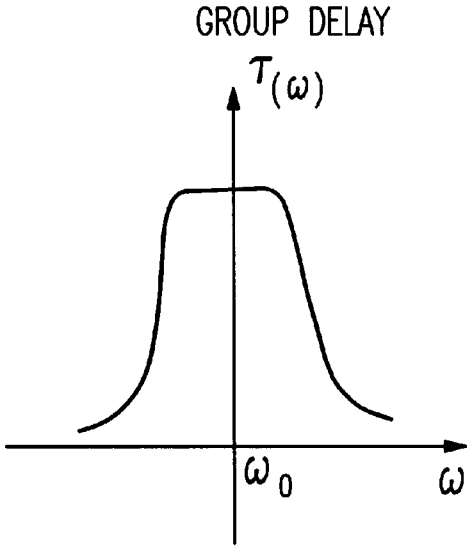
Figure 25:
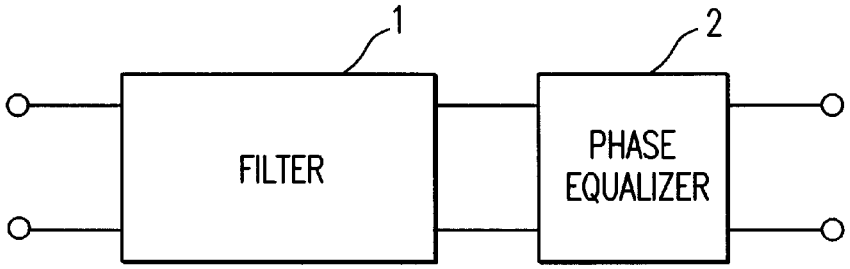
FIG. 25 PRIOR ART
FIG. 25 is a block diagram showing a configuration example of the prior art bandpass filter.
Figure 26:
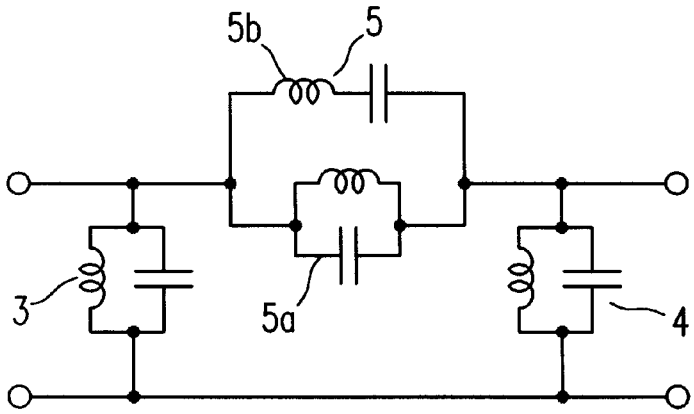
FIG. 26 PRIOR ART
FIG. 26 is a circuit diagram showing a configuration example for realizing transmission zeros in the stopbands of the prior art filter.
Figure 27:
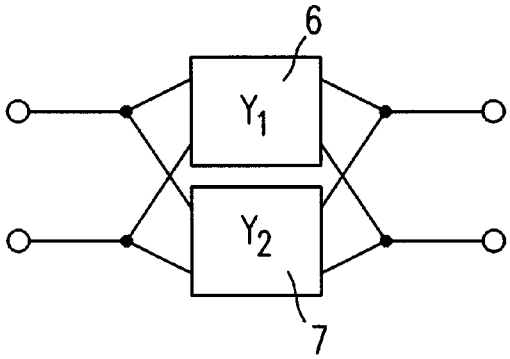
FIG. 27 PRIOR ART
FIG. 27 is a block diagram showing a configuration example for realizing transmission zeros in the stopbands of the prior art filter.
Figure 28:
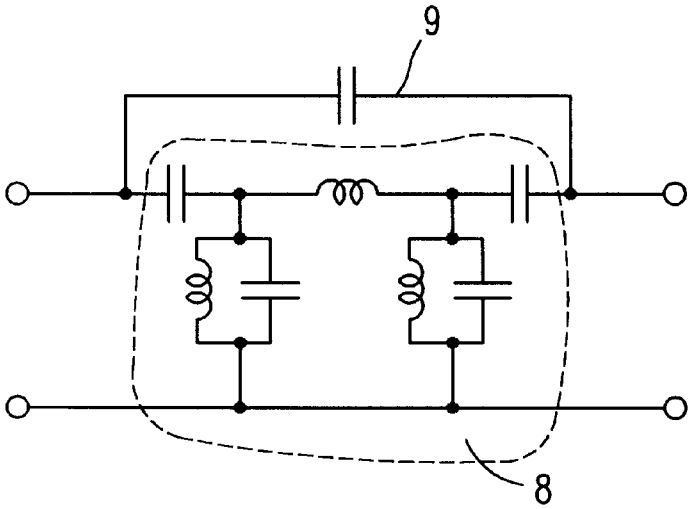
FIG. 28 PRIOR ART
FIG. 28 is a circuit diagram showing a configuration example for realizing transmission zeros in the stopbands of the prior art filter.

In the configuration example shown in FIG. 8, the distributed element filter of the invention is constructed of distributed element circuit elements formed as a conductive pattern on a dielectric substrate; in the illustrated example, seven circular patch resonators 33 to 39 are connected by electric field couplings 25 to 31. FIG. 23 is a cross sectional view taken along cutting plane XXIII—XXIII in FIG. 8. In this distributed element filter, a conductor 215 is attached fixedly over the entire surface on one side of the dielectric substrate 214. The conductor 215 is grounded. On the other surface of the substrate 214 are formed fixedly the resonators 33 to 39, strip transmission line 32, terminals 40*a*, 41*a*, etc. In FIG. 8, solid arrows in each of the resonators 33 to 39 show the magnetic field, and the direction perpendicular to the plane of the page is the direction of the electric field; this also applies to the diagrams of FIGS. 12, 15. The substrate 214 may be made of a fluororesin such as F4 (trademark) or other material such as ceramic. The conductor 215, the resonators 33 to 39, the strip transmission line 32, the terminals 40*a*, 41*a*, etc. may be formed of copper or other metallic material. In FIG. 8, the resonators 36, 39 are connected by magnetic coupling via a short strip transmission line 32 both ends of which are grounded via a through-hole conductor to the ground conductor formed on the reverse side of the dielectric substrate. The external terminals 40*a*, 41*a* corresponding to the terminals 89, 87 are connected to this filter, and in each of the resonators 33 to 39, the magnetic field is shown by solid lines, and the direction of the electric field is also shown.

In the thus constructed distributed element filter of the invention, the coupling portions 25 to 28 in FIG. 8 correspond to the coupling elements 10 to 13 in the first unit coupling circuit 83 shown in FIG. 6, and the resonators 33 to 36 in FIG. 6 correspond to the resonant circuits (resonators) 18 to 21 shown in FIG. 6. Similarly, the coupling portions 29 to 32 in FIG. 8 correspond to the coupling elements 14 to 17 in the second unit coupling circuit 84 shown in FIG. 6, and the resonators 37 to 39 in FIG. 8 correspond to the resonant circuits (resonators) 22 to 24 shown in FIG. 6. If the resonance mode of each of the resonators 33 to 39 is $E_{210}$, electric field maximum points are located 90 degrees apart from each other on the circumference of each of the resonators 33 to 39, and electric field coupling or capacitive coupling occurs at these points. At intermediate points between the respective electric field maximum points, i.e., at points spaced 45 degrees apart from the respective electric field maximum points are located magnetic field maximum points where magnetic field coupling or inductive coupling occurs. Using such configuration, the distributed element filter as the target bandpass filter can be constructed by coupling the seven resonators 33 to 39 as shown in FIG. 8.

According to the thus constructed distributed element filter of the invention, since the bandpass filter represented by the strictly equivalent circuit shown in FIG. 7 can be realized accurately as a conductive pattern shown in FIG. 8 for each of the elements 37 to 39, not only can the filter be realized with simple circuitry by designing the circuit using an accurate design procedure, but also the filter can be constructed using the minimum necessary number of elements and patterns to provide the required characteristics. The distributed element filter thus constructed has low element sensitivity and low losses.

Figure 11:
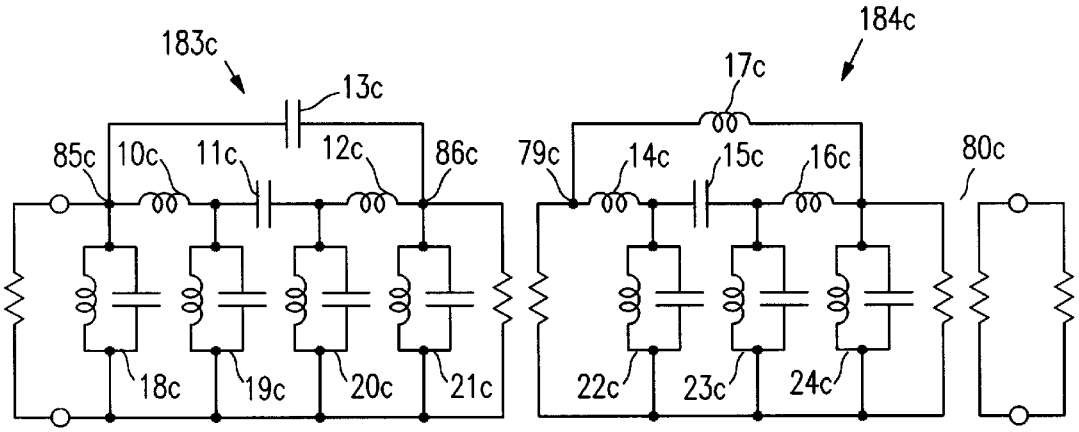
FIG. 11 is an equivalent circuit diagram showing an embodiment of the bandpass filter according to the invention.
Figure 12:
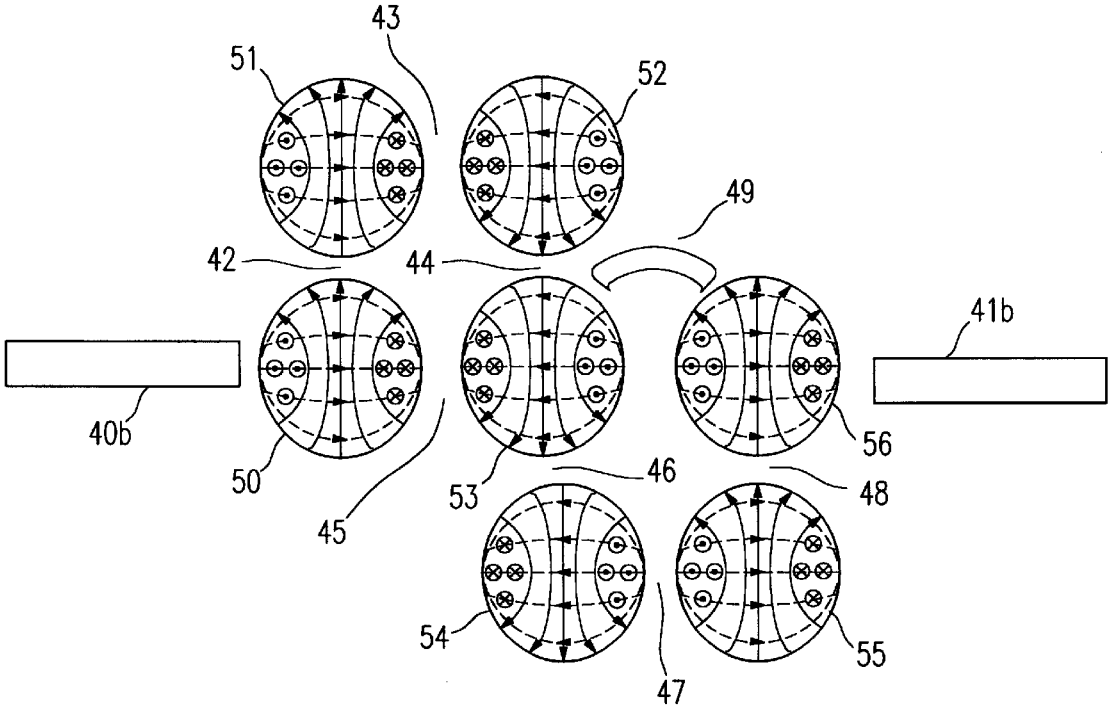
FIG. 12 is a plan view showing a configuration example when the embodiment of the bandpass filter of FIG. 11 is realized by a distributed element filter.
Figure 13:
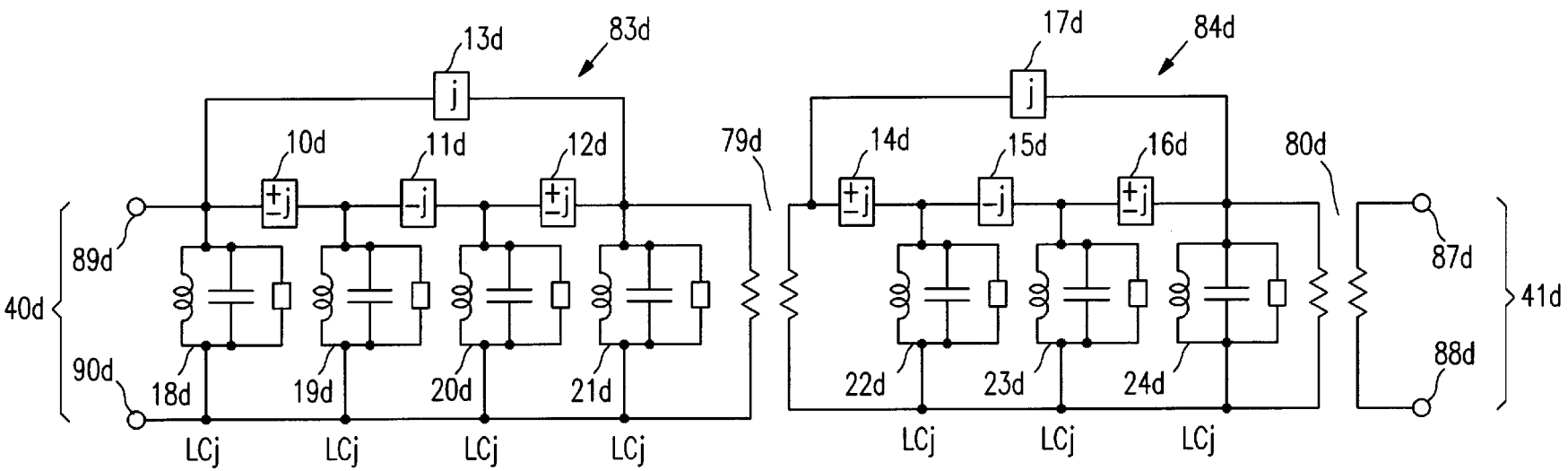
FIG. 13 is a circuit diagram showing an example of transformation to the bandpass filter according to the invention.

FIGS. 11 to 13 show a second embodiment of the invention. FIG. 11 is an equivalent circuit showing a bandpass filter obtained as the result of a narrowband approximation. FIG. 12 is a conceptual circuit pattern for a distributed element filter obtained based on the equivalent filter circuit shown in FIG. 11. This embodiment is analogous to the foregoing embodiment, and corresponding parts are designated by the same reference characters. In the second embodiment, the lowest order realization of the distributed element filter is expressed by the network function for s21 previously given in equation 1, and the design procedure is the same as that previously shown in FIGS. 9, 10. In the second embodiment, the lowpass prototype filter shown in FIG. 1 is determined in accordance with the network function for s21, and is transformed to the equivalent circuit of FIG. 2 using the imaginary gyrators 64, 65 shown in FIG. 2, and further, an equivalent circuit as previously described in connection with FIG. 5 is constructed. The signs of the gyrators 64, 67, 68 in FIG. 3 are assumed to be positive unless otherwise indicated. In this way, the equivalent lowpass prototype filter shown in FIG. 4 is obtained. Further, frequency and impedance transformations are applied, as shown in FIG. 5, and the target bandpass distributed element filter shown in FIG. 13 is realized. The design procedure shown in FIGS. 9, 10 is thus completed.

In addition, in this particular embodiment of the invention, the sign is varied between adjacent coupling elements in the cascade of the coupling reactive elements 10*d*, 11*d*, 12*d*, or 14*d*, 15*d*, 16*d*, in FIG. 13 in order to suppress unwanted cross coupling between the coupling elements. That is, the sign of the first coupling element 10*d*, 14*d* is made the same as the sign the third coupling elements 12*d*, 16*d*, respectively. The sign of the first coupling elements 10*d*, 14*d* or the third coupling elements 12*d*, 16*d* is made different from the sign of the second coupling elements 11*d*, 15*d*. More specifically, the combination is such that the sign is inverted from one coupling element to the next, in the order of the first coupling elements 10*d*, 14*d*, the second coupling elements 11*d*, 15*d*, and the third coupling elements 12*d*, 18*d*, alternating between electric field coupling and magnetic field coupling. Since the first coupling elements 10*d*, 14*d* and the second coupling elements 11*d*, 15*d* are coupling elements of unlike sign, one being electric field coupling and the other being magnetic field coupling, coupling by the coupling elements of unlike sign is suppressed to prevent undesired cross coupling from the resonator 18*d* to the resonator 20*d*. This effect is the same for the case of the third coupling elements 12*d*, 16*d* versus the second coupling elements 11*d*, 15*d* as well as the resonator 21*d* versus the first resonator 19*d*.

In FIG. 13, attention is directed to the circuits 83*d*, 84*d* to the left and right of the ideal transformer 79*d* at the center.

Fox example, the circuit 83*d* to the left of the ideal transformer 79*d* is made to correspond to the conjugate zeros on the real axis of the numerator rational polynomial f(s), and the circuit 84 to the right is made to correspond to the conjugate zeros on the imaginary axis of the numerator rational polynomial f(s) Then, of the coupling elements, the circuits 10*d*, 12*d*, 14*d*, 16*d*, 17*d* are realized by magnetic field coupling, while the circuits 11*d*, 13*d*, 15*d* are realized by electric field coupling, or vice versa.

FIG. 11 shows the equivalent circuit of the embodiment of the bandpass filter circuit obtained as the result of the narrowband approximation, FIG. 12 is a plan view showing a configuration example of the distributed element filter of the invention as implemented in the narrowband approximated embodiment shown in FIG. 11. In the configuration example shown in FIG. 12, the distributed element filter of the invention is constructed of distributed element circuit elements formed as a conductive pattern on a dielectric substrate; in the illustrated example, seven circular patch resonators 50 to 56 are used in $E_{110}$ mode.

In the thus constructed distributed element filter of the invention, the coupling portions 42 to 45 in FIG. 12 correspond to the coupling elements 10*d* to 13*d* in the first unit coupling circuit shown in FIG. 13, and the resonators 50 to 53 in FIG. 12 correspond to the resonant circuits (resonators) 18*d* to 21*d* shown in FIG. 13. Similarly, the coupling portions 46 to 49 in FIG. 12 correspond to the coupling elements 14*d* to 17*d* in the second unit coupling circuit shown in FIG. 13, and the resonators 54 to 56 in FIG. 13 correspond to the resonant circuits (resonators) 22*d* to 24*d* shown in FIG. 13. If the resonance mode of each of the resonators 50 to 56 is $E_{110}$, electric field maximum points are located 180 degrees apart from each other on the circumference of each of the resonators, as shown in FIG. 12, and electric field coupling occurs at these points. At intermediate points between the respective electric field maximum points, i.e., at points spaced 90 degrees apart from the respective electric field maximum points are located magnetic field maximum points where magnetic field coupling occurs. Using such configuration, the distributed element filter as the target bandpass filter can be constructed by coupling the seven resonators 50 to 56 as shown in FIG. 12.

In FIG. 12, the coupling portions 43, 45, 47 are realized by electric field coupling, while the coupling portions 42, 44, 46, 48, 49 are realized by magnetic field coupling, thus preventing undesired cross couplings.

According to the thus constructed distributed element filter of the invention, since the bandpass filter represented by the strictly equivalent circuit shown in FIG. 11 can be realized accurately as a conductive pattern shown in FIG. 12 for each element, not only can the filter be realized with simple circuitry by designing the circuit using an accurate design procedure, but also the filter can be constructed using the minimum necessary number of elements and patterns to provide the required characteristics. The distributed element filter thus constructed has low element sensitivity and low losses.

A third embodiment of the invention will be described with reference to FIGS. 14 to 22. This embodiment also is analogous to the first described embodiment.

According to the third embodiment of the distributed element filter of the invention shown in FIGS. 17 to 22, since the circuit block corresponding to conjugate zeros on the real axis and conjugate zeros on the imaginary axis of the numerator rational polynomial of the network function and to their corresponding denominator rational polynomial is realized by a multiple resonator filter having one or more multiple coupling circuit blocks of the previously described configuration, a circuit with improved performance can be constructed and realized in a theoretically strictly manner by minimizing losses while simplifying the configuration of the filter.

The lowest polynomial degree necessary to achieve the target characteristics of the distributed element filter of the invention, i.e., flat amplitude and flat group delay characteristics in the passband and transmission zeros (attenuation poles) in the stopbands, is 4 for the numerator rational polynomial and 6 for the denominator rational polynomial. That is, the numerator rational polynomial here is a polynomial of degree 4 or higher having at least one conjugate zeros on the real axis and one conjugate zeros on the imaginary axis. On the other hand, the degree m2 of the denominator rational polynomial, a Hurwitz polynomial, is higher than the degree n1 of the numerator rational polynomial by degree 2 or more ($n1+2 \leqq m2$), and the degree m2 of the Hurwitz polynomial as the denominator rational polynomial corresponds to the number of resonators forming the distributed element filter of the invention.

The circuit block corresponding to the numerator rational polynomial of degree 4 and the denominator rational polynomial of degree 6 is realized by a multiple resonator filter having one or more multiple coupling circuit blocks, each multiple coupling circuit block comprising first to fourth resonators, a first coupling element for coupling the first resonator in cascade with a circuit located outward thereof, a second coupling element for coupling the first and second resonators in cascade, a third coupling element for coupling the second and third resonators in cascade, a fourth coupling element for coupling the third and fourth resonators in cascade, a fifth coupling element for coupling the fourth resonator in cascade with a circuit located outward thereof, a sixth coupling element for bridge-coupling the outward portions of the second and fourth coupling elements, and a seventh coupling element for bridge-coupling the outward portions of the first and fifth coupling elements, wherein the first to seventh coupling elements are a combination of electric field coupling and magnetic field coupling, such that (a) the sixth and seventh coupling elements are realized by electric field coupling and, of the first to fifth coupling elements, one or three coupling elements are realized by magnetic field coupling and the others by electric field coupling, (b) the sixth and seventh coupling elements are realized by magnetic field coupling and, of the first to fifth coupling elements, two or four coupling elements are realized by magnetic field coupling and the others by electric field coupling, (c) the sixth coupling element is realized by electric field coupling and the seventh coupling element by magnetic field coupling and, of the first to fifth coupling elements, zero or two or four coupling elements are realized by magnetic field coupling and the others by electric field coupling, or (d) the sixth coupling element is realized by magnetic field coupling and the seventh coupling element by electric field coupling and, of the first to fifth coupling elements, one or three or five circuits are realized by magnetic field coupling and the others by electric field coupling.

The distributed element filter of the invention is realized by an unbalanced distributed element circuit; in this multiple coupling circuit block, each coupling element can be realized by a mutual electric field coupling produced by electric charges on each resonator in the multiple coupling circuit block, or likewise by a mutual magnetic field coupling produced by an electric currents on each resonator, The sixth and seventh coupling elements can also be realized, for example, by lumped reactive elements, or by an electric field coupling produced by electric charges on resonators at both ends of the bridge coupling effected by them, or by a magnetic coupling produced by an electric current.

In the distributed element filter of the invention shown in FIGS. 17 to 22, the nuerator rational polynomial of the lowpass prototype filter transfer function s21 is an even polynomial of complex frequency s of degree 4 or higher, and the denominator rational polynomial is a Huzwitz polynomial of complex frequency s of degree 6 or higher. The third embodiment of the invention is also analogous to the previously described first embodiment of the invention.

The distributed element filter of the invention will be described in detail below.

As the lowest order realization of the distributed element filter of the invention, in step a1 of FIG. 9, the numerator rational polynomial is set as a polynomial f(s) of degree 4 having one conjugate zeros on the real axis and one conjugate zeros on the imaginary axis, and the denominator rational polynomial as a Hurwitz polynomial g(s) of degree 6; then the network function for s21 is expressed as a function of the complex frequency $s=\sigma+j\Omega$ $$s21 = \frac{f(s)}{g(s)} = \frac{b_4s^4 + b_2s^2 + b_0}{a_6s^6 + a_5s^5 + a_4s^4 + a_3s^3 + a_2s^2 + a_1s + a_0} \quad (2)$$

Here, the denominator rational polynomial g(s) is a polynomial, for example, a Bessel polynomial, which provides a flat group delay characteristic.

Next, the amplitude characteristic of the denominator rational polynomial is adjusted by the numerator rational polynomial without adversely affecting the group delay characteristic, and transmission zeros are provided in the stopband by using the conjugate zeros on the imaginary axis of the numerator rational polynomial. Further, the amplitude characteristic is adjusted using the conjugate zeros on the real axis of the numerator rational polynomial so that the amplitude characteristic is made as flat as possible throughout the passband. In this way, the numerator rational polynomial is determined in accordance with the denominator rational polynomial and the target filter characteristics.

Figure 16:
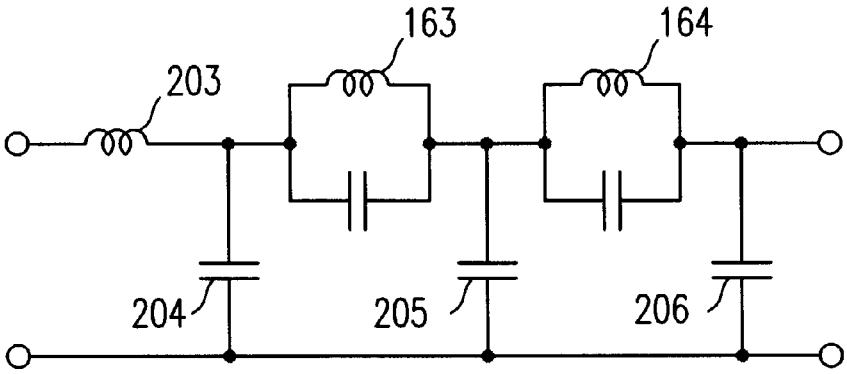
FIG. 16 is a circuit diagram showing an example of a lowpass prototype filter according to the invention.

The circuit parameters for the lowpass prototype filter as illustrated in the circuit diagram of FIG. 16 are derived from the thus determined polynomials. In this lowpass prototype filter, the number of stages 163, 164, and 203 to 206 connected in series or parallel in a ladder configuration corresponds to the degree m2 of the Hurwitz polynomial which, in the illustrated example, is 6. Two parallel resonant circuits 163, 164 connected in series are circuit blocks corresponding respectively to the conjugate zeros on the real axis and conjugate zeros on the imaginary axis of the numerator rational polynomial.

Of the circuit blocks 163, 164 corresponding to the conjugate zeros on the real axis and conjugate zeros on the imaginary axis, the circuit elements of the series resonant circuit corresponding to the conjugate zeros on the imaginary axis are both positive in value and are therefore realizable in a practical circuit. On the other hand, one or the other of the circuit elements forming the parallel resonant circuit corresponding to the conjugate zeros on the real axis is negative in value and, therefore, this resonant circuit cannot be realized directly in a practical circuit.

Accordingly, an equivalent transformation is performed to form a multiple coupling circuit block. That is, the circuit shown in FIG. 16 is transformed to the equivalent circuit shown in FIG. 17 by using imaginary gyrators 161, 162. In the circuit shown in FIG. 17, focusing attention on the section containing the imaginary gyrator 162 and two parallel resonant circuits 163, 164, a portion such as shown in FIG. 18A is considered. Then, for this circuit, a circuit containing five imaginary gyrators 167 to 171, as shown in FIG. 18B, is considered; it can then be seen that by suitably replacing the parameters of the circuits of FIGS. 18A, 18B, both circuits become equivalent. L and C in FIG. 18B indicate that the designated circuit elements are inductors and capacitors, respectively, and their values are not given. Likewise, the imaginary gyrators 167 to 171 are indicated by j, and their values may differ from each other. The imaginary gyrators 167 to 171 are each assumed to have a positive or negative constant value, unless the sign is specifically indicated. This also applies to FIGS. 19 to 21 hereinafter given.

Figure 17:
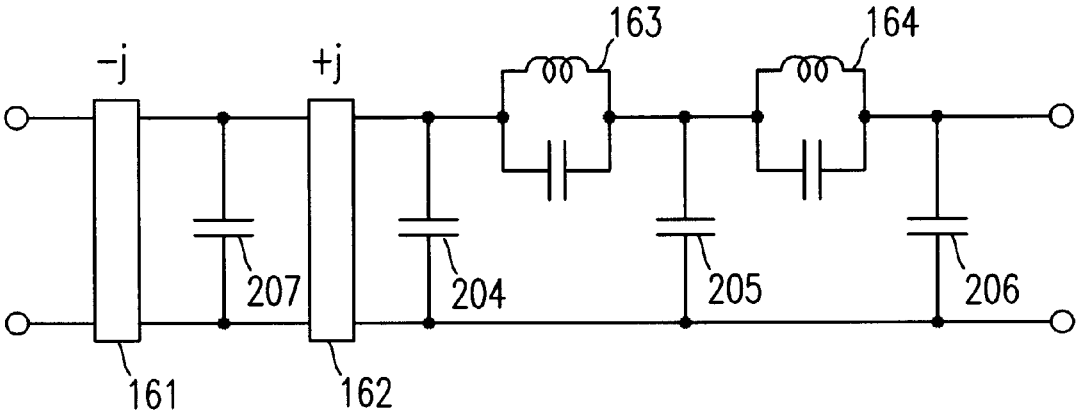
FIG. 17 is a circuit diagram showing an example of an equivalently transformed lowpass prototype filter according to the invention.
Figure 18A:
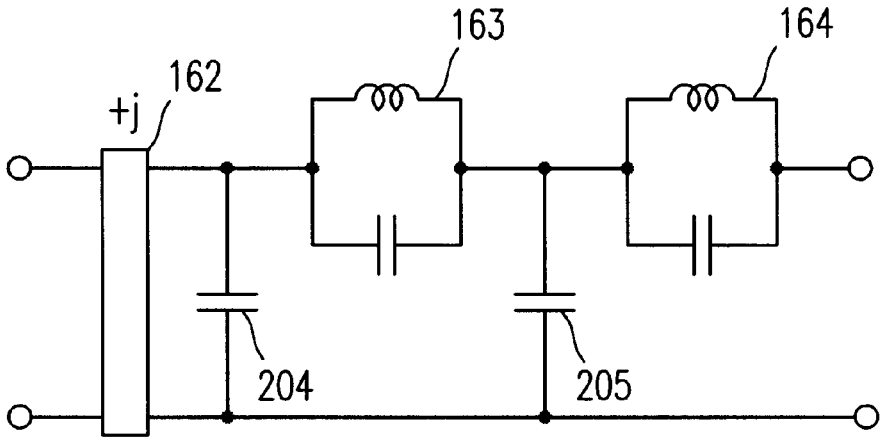
FIGS. 18A, 18B are circuit diagrams showing an example of the equivalent transformation of a multiple coupling circuit block in the lowpass prototype filter according to the invention.
Figure 18B:
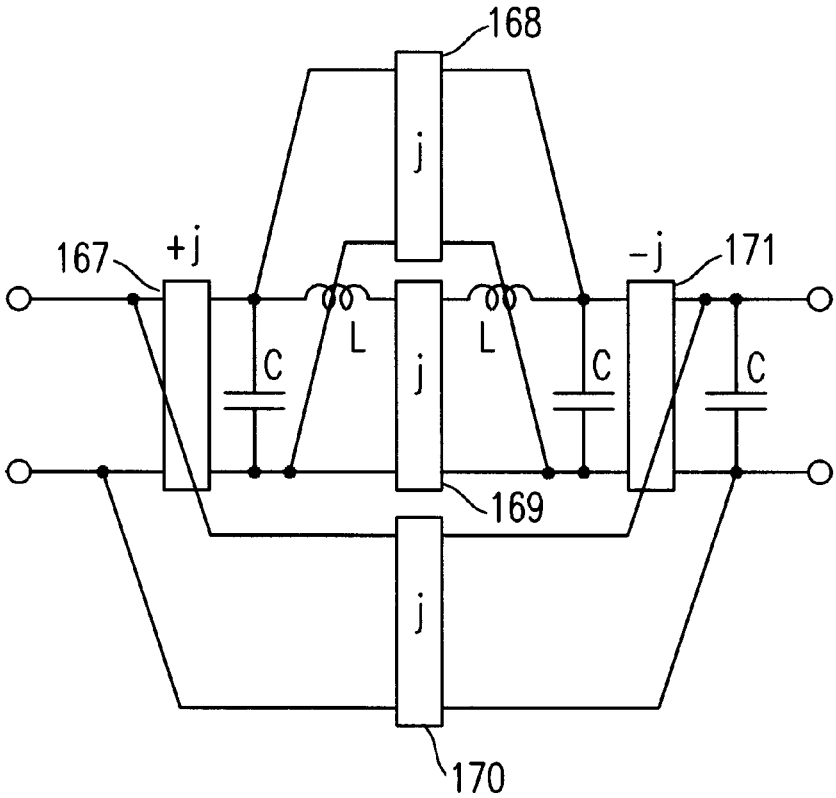
Figure 19:
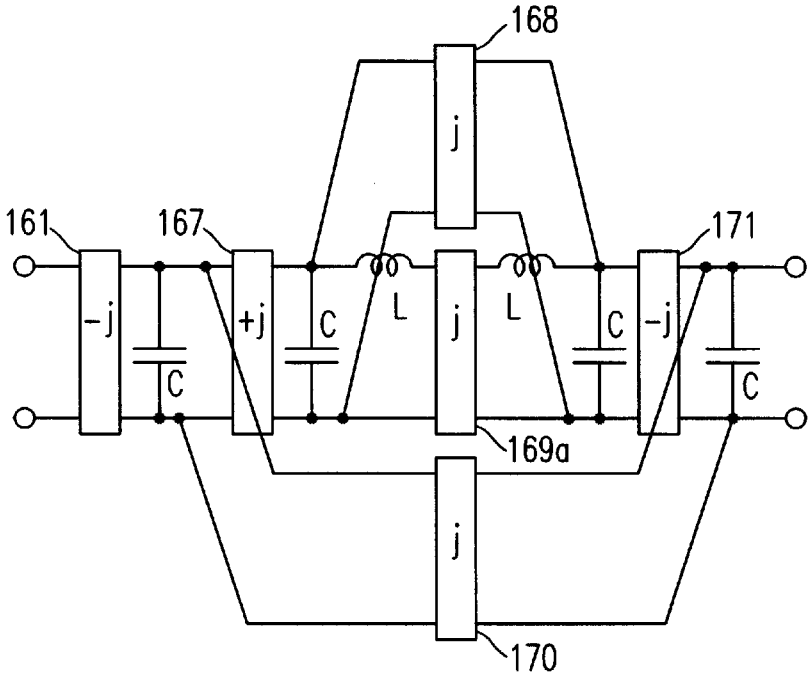
FIG. 19 is a circuit diagram showing an example of the equivalently transformed lowpass prototype filter according to the invention.

In this way, the lowpass prototype filter shown in FIG. 16 is transformed through the equivalent transformations of FIGS. 17, 18 into the equivalent lowpass prototype filter shown in FIG. 19.

Figure 20:
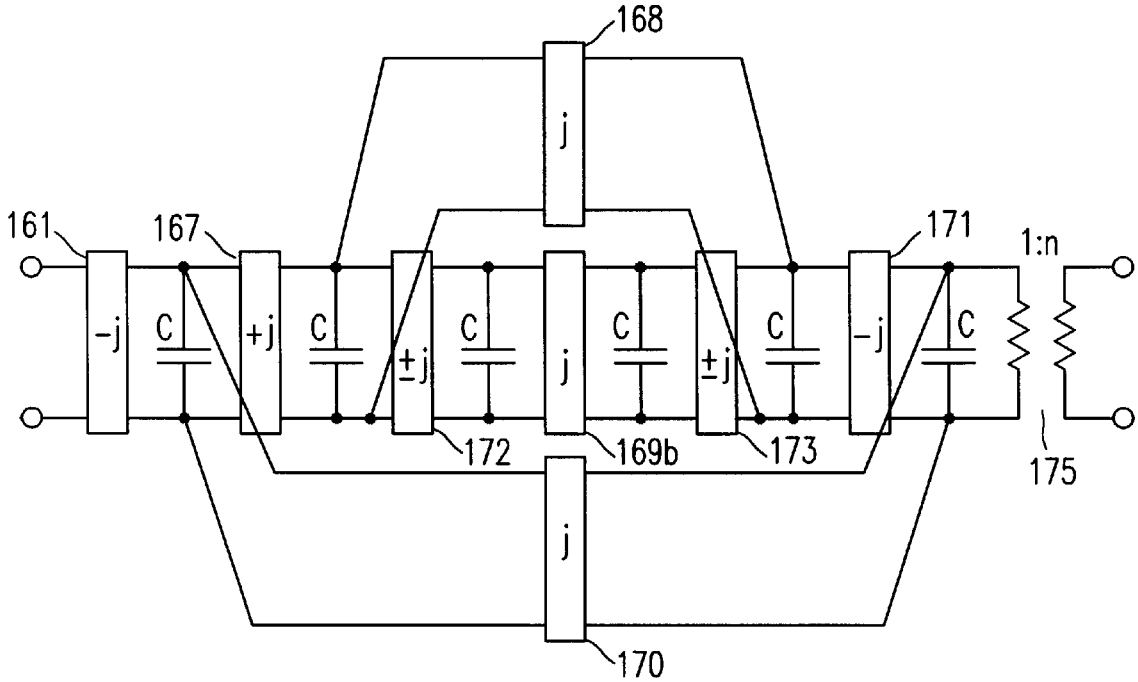
FIG. 20 is a circuit diagram showing an example of the equivalently transformed lowpass prototype filter according to the invention.

Imaginary gyrators 172, 173 and an ideal transformer 175 are introduced in the equivalent lowpass prototype filter shown in FIG. 19 to transform the circuit elements to equivalent capacitors C arranged in parallel and all having the same value. The result is the equivalent lowpass prototype filter shown in FIG. 20, which is strictly and exactly equivalent to the lowpass prototype filter shown in FIG. 16. When the equivalent transformation is applied, the imaginary gyrators 172, 173 can take double sign as shown in FIG. 20.

Next, frequency and impedance transformations are applied to this lowpass prototype filter to transform it to the bandpass filter having the target bandpass characteristics. At this time, the capacitors in the circuit of FIG. 20 are transformed to parallel resonant circuits 110 to 115 as the result of the frequency transformation, but all the imaginary gyrators 161, 167 to 173 and 176 remain unchanged. Here, an imaginary gyrator 176 which includes an ideal transformer is inserted at the output end to improve the symmetry between the input and output ends of the filter. With the inclusion of the imaginary gyrator 176, the filter output impedance at the output end is transformed to an output admittance, but the transmission characteristics such as the amplitude and group delay characteristics of the filter do not change. In this way, the passband filter shown in FIG. 21 is obtained.

Figure 21:
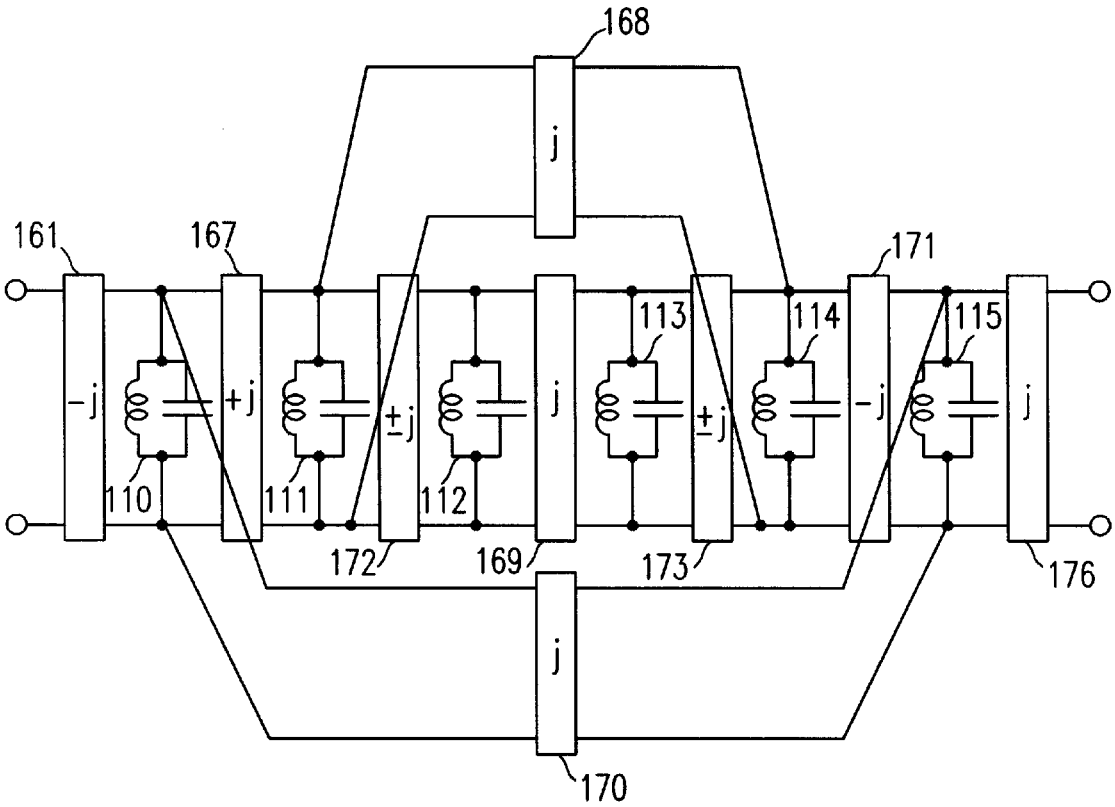
FIG. 21 is a circuit diagram showing a configuration example of a bandpass filter according to the invention obtained after the equivalent transformation.
Figure 22:
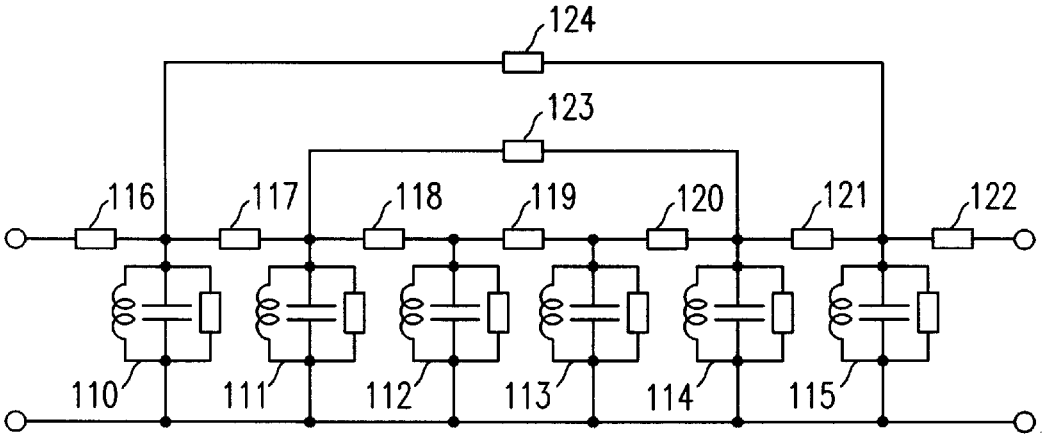
FIG. 22 is a circuit diagram showing an example of transformation to the bandpass filter according to the invention.

When the imaginary gyrators 167, 173, 169, 174, 171, 168, 170 in FIG. 21 are implemented by π-type connections of constant reactive elements and the imaginary gyrators are implemented by narrowband approximation, the target bandpass filter of the circuit configuration shown in FIG. 22 is realized. The constant reactive elements in the coupling elements 116 to 124 can each be realized by electric or magnetic field coupling, using a narrowband approximation around the passband.

Here, the constant reactive elements in the seven coupling elements 117, 118, 119, 120, 121, 123, 124, and the four resonant circuits (resonators) 111, 112, 113, 114, together constitute one multiple coupling circuit block. The filter then comprises the first coupling element 117 for connecting the first resonator 111 in cascade with a circuit located outward thereof, the second coupling element 118 for connecting the first resonator 111 and the second resonator 112 in cascade, the third coupling element 119 for connecting the second resonator 112 and the third resonator 113 in cascade, the fourth coupling element 120 for connecting the third resonator 113 and the fourth resonator 114 in cascade, the fifth coupling element 121 for bridge-coupling the fourth resonator 114 with a circuit located outward thereof, the sixth coupling element 123 for bridge-coupling the outward portions of the second coupling element 118 and fourth coupling element 120, and the seventh coupling element 124 for bridge-coupling the outward portions of the first coupling element 117 and fifth coupling element 121.

If the circuit sections corresponding to conjugate zeros on the real axis and conjugate zeros on the imaginary axis of the numerator rational polynomial f(s) shown in equation 2 are to be realized using the multiple coupling circuit block realized by the first to seventh coupling elements 117 to 123 and first to fourth resonators 111 to 114, the signs of the first to seventh coupling elements 117 to 123 realized by constant reactive elements should be set in accordance with one of the following four combinations a to d. a: The sixth and seventh coupling elements 122, 123 are both negative (−) in sign and, of the first to fifth coupling elements 117 to 121, one or three coupling elements are positive (+) in sign and the others are negative. b: The sixth and seventh coupling elements 122, 123 are both positive in sign and, of the first to fifth coupling elements 117 to 121, two or four coupling elements are positive in sign and the others are negative. c: The sixth coupling element 122 is negative in sign, the seventh coupling element 123 is positive in sign and, of the first to fifth coupling elements 117 to 121, zero or two or four coupling elements are positive in sign and the others are negative. d: The sixth coupling element 122 is positive in sign, the seventh coupling element 123 is negative in sign and, of the first to fifth coupling elements 117 to 121, one or three or five coupling elements are positive in sign and the others are negative.

The reason that the sign combinations, a to d, are available for the first to seventh coupling elements 117 to 123 is that the combination of electric field coupling versus magnetic field coupling for the first to seventh coupling elements 117 to 123 which realizes the above polynomial is determined by equivalent transformation, and there are 20 possible combinations as shown in Table 1 where the electric field coupling is denoted by (−) and the magnetic field coupling by (+).

TABLE 1

| COUPLING ELEMENT | SIXTH ELEMENT 123 | SEVENTH ELEMENT 124 | FIRST ELEMENT 117 | SECOND ELEMENT 118 | THIRD ELEMENT 119 | FOURTH ELEMENT 120 | FIFTH ELEMENT 121 |
|---|---|---|---|---|---|---|---|
| COMBINATIONS OF | (−) | (−) | (+) | (−) | (−) | (−) | (−) |
| ELECTRIC FIELD COUPLING (−) | | | (+) | (+) | (+) | (−) | (−) |
| VERSUS | | | (+) | (+) | (−) | (+) | (−) |
| MAGNETIC FIELD COUPLING (+) | | | (+) | (−) | (+) | (+) | (−) |
| | (+) | (+) | (+) | (+) | (−) | (−) | (−) |
| | | | (+) | (−) | (+) | (−) | (−) |
| | | | (+) | (−) | (−) | (+) | (−) |
| | | | (+) | (+) | (+) | (+) | (−) |
| | (−) | (+) | (−) | (−) | (−) | (−) | (−) |
| | | | (−) | (+) | (+) | (−) | (−) |
| | | | (−) | (+) | (−) | (+) | (−) |
| | | | (+) | (−) | (−) | (−) | (+) |
| | | | (+) | (+) | (+) | (−) | (+) |
| | | | (+) | (+) | (−) | (+) | (+) |
| | (+) | (−) | (−) | (+) | (−) | (−) | (−) |
| | | | (−) | (−) | (+) | (−) | (−) |
| | | | (−) | (+) | (+) | (+) | (−) |
| | | | (+) | (+) | (−) | (−) | (+) |
| | | | (+) | (−) | (+) | (−) | (+) |
| | | | (+) | (+) | (+) | (+) | (+) |

As for the constant reactive elements of the coupling elements 116 to 124 in the bandpass filter, the constant reactive elements of negative sign or positive sign can be realized by electric field coupling or magnetic field coupling or by capacitors or inductors, respectively, through a narrowband approximation around the passband.

Figure 14:
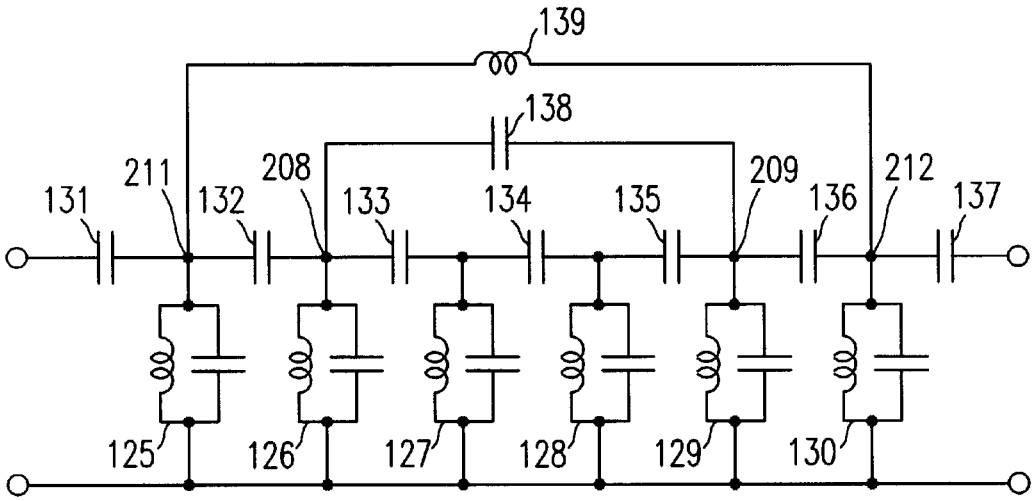
FIG. 14 is an equivalent circuit diagram showing an embodiment of the bandpass filter according to the invention.

FIG. 14 shows the circuit diagram of the embodiment of the bandpass filter circuit obtained as the result of the narrowband approximation. In the illustrated example, the combination c, where the sixth coupling element 122 is negative in sign, the seventh coupling element 123 is positive in sign, and the first to fifth coupling elements 117 to 121 are negative in sign, is chosen for the circuit realization.

Figure 15:
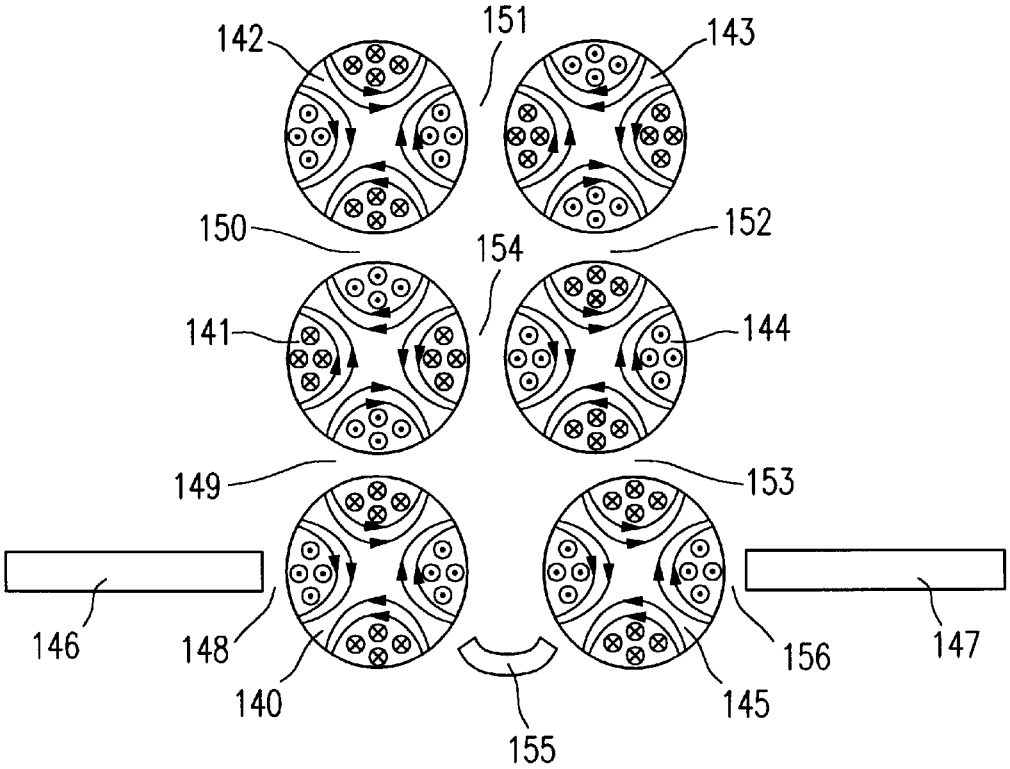
FIG. 15 is a plan view showing a configuration example when the embodiment of the bandpass filter of FIG. 14 is realized by a distributed element filter.

FIG. 15 is a plan view showing a configuration example of the distributed element filter of the invention as implemented in the embodiment of the bandpass filter shown in FIG. 14.

In the configuration example shown in FIG. 15, the distributed element filter of the invention is constructed of distributed element circuit elements formed as a conductive pattern on a dielectric substrate; in the illustrated example, sixth circular patch resonators 140 to 145 are used in $E_{110}$ mode.

In the thus constructed distributed element filter of the invention, the coupling portions 148 to 156 in FIG. 15 correspond to the first to seventh coupling elements 131 to 139 in the multiple coupling circuit block shown in FIG, 14, and the resonators 140 to 145 in FIG. 15 correspond to the resonant circuits (resonators) 125 to 130 shown in FIG. 14. If the resonance mode of each of the resonators 140 to 145 is $E_{210}$, electric field maximum points are located 90 degrees apart from each other on the circumference of each of the resonators, as shown in FIG. 15, and electric field coupling occurs at these points. At intermediate points between the respective electric field maximum points, i.e., at points spaced 45 degrees apart from the respective electric field maximum points are located magnetic field maximum points where magnetic field coupling occurs. In FIG. 15, curved lines with arrows shown in each of the resonators 140 to 145 formed from the conductive pattern indicate the direction of the magnetic field parallel to the plane of the page, and marks ● and X shown inside each curved line indicate the direction of the electric field perpendicular to the plane of the page. Using such configuration, the distributed element filter as the target bandpass filter can be constructed by coupling the six resonators 140 to 145 as shown in FIG. 15. In FIG. 15, electric field couplings 148 to 154 and 156 and magnetic field coupling 155 are realized.

According to the thus constructed distributed element filter of the invention, since the bandpass filter represented by the strictly equivalent circuit shown in FIG. 14 can be realized accurately as a conductive pattern shown in FIG. 15 for each element, not only can the filter be realized with simple circuitry by designing the circuit using an accurate design procedure, but also the filter can be constructed using the minimum necessary number of elements and patterns to provide the required characteristics. The distributed element filter thus constructed has low element sensitivity and low losses.

Furthermore, according to the distributed element filter of the invention, since an increase in the degree of the numerator polynomial involves only the same increase in the degree of the denominator polynomial, the degree of the numerator rational polynomial realizable by a given number of resonators can be made higher compared with the second embodiment. This offers an enormous practical advantage of reducing the design constraints in the realization of a filter having complex characteristics.

The above-described embodiments of the invention are only illustrative and not restrictive, and it will be appreciated that various changes and modifications may be made without departing from the spirit and scope of the invention. For example, resonator patterns of other geometry may be used, and the resonators may be directly coupled by magnetic field coupling.

For example, resonator patterns of other geometry may be used. Further, all the electric field/magnetic field coupling combinations in the embodiment shown in FIG. 2 may be interchanged, or the electric field/magnetic field coupling combinations may be interchanged in each of the unit coupling circuit blocks in the embodiment shown in FIG. 2.

For example, resonator patterns of other geometry may be used for the conductive pattern of the resonators forming the distributed element filter. Further, the electric field/magnetic field coupling combinations in the embodiment shown in FIG. 8 may be changed according to the combinations of double sign as shown in FIG. 5.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of degree 6 or higher of the complex frequency s, the distributed element circuit comprising:

a multiple coupling circuit block including:

first to fourth resonators;

a first coupling element for connecting the first resonator in cascade with a first external resonator located outward of the first resonator;

a second coupling element for connecting the first resonator and the second resonator in cascade;

a third coupling element for connecting the second resonator and the third resonator in cascade;

a fourth coupling element for connecting the third resonator and the fourth resonator in cascade;

a fifth coupling element for connecting the fourth resonator in cascade with a second external resonator located outward of the fourth resonator;

a sixth coupling element for bridge-coupling a connection point between the first and second coupling elements and the first resonator with a connection point between the fourth and fifth coupling elements and the fourth resonator; and a seventh coupling element for bridge-coupling a connection point between the first coupling element and the first external resonator with a connection point between the fifth coupling element and the second external resonator, wherein of the first to seventh coupling elements, the sixth and seventh coupling elements are realized by electric field coupling and, of the first to fifth coupling elements, one or three coupling elements are realized by magnetic coupling and the others by electric field coupling.

2. A distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of degree 6 or higher of the complex frequency s, the distributed element circuit comprising:

a multiple coupling circuit block including:

first to fourth resonators;

a first coupling element for connecting the first resonator in cascade with a first external resonator located outward of the first resonator;

a second coupling element for connecting the first resonator and the second resonator in cascade;

a third coupling element for connecting the second resonator and the third resonator in cascade;

a fourth coupling element for connecting the third resonator and the fourth resonator in cascade;

a fifth coupling element for connecting the fourth resonator in cascade with a second external resonator located outward of the fourth resonator;

a sixth coupling element for bridge-coupling a connection point between the first and second coupling elements and the first resonator with a connection point between the fourth and fifth coupling elements and the fourth resonator; and a seventh coupling element for bridge-coupling a connection point between the first coupling element and the first external resonator with a connection point between the fifth coupling element and the second external resonator, wherein the sixth and seventh coupling elements are realized by magnetic field coupling and, of the first to fifth coupling elements, two or four coupling elements are realized by magnetic coupling and the others by electric field coupling.

3. A distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of degree 6 or higher of the complex frequency s, the distributed element circuit comprising a multiple coupling circuit block including:

first to fourth resonators;

a first coupling element for connecting the first resonator in cascade with a first external resonator located outward of the first resonator;

a second coupling element for connecting the first resonator and the second resonator in cascade;

a third coupling element for connecting the second resonator and the third resonator in cascade;

a fourth coupling element for connecting the third resonator and the fourth resonator in cascade;

a fifth coupling element for connecting the fourth resonator in cascade with a second external resonator located outward of the fourth resonator;

a sixth coupling element for bridge-coupling a connection point between the first and second coupling elements and the first resonator with a connection point between the fourth and fifth coupling elements and the fourth resonator; and a seventh coupling element for bridge-coupling a connection point between the first coupling element and the first external resonator with a connection point between the fifth coupling element and the second external resonator, wherein the sixth coupling element is realized by electric field coupling and the seventh coupling element by magnetic field coupling and, of the first to fifth coupling elements, zero or two or four coupling elements are realized by magnetic coupling and the others by electric field coupling.

4. A distributed element filter with bandpass characteristics, constructed of an unbalanced distributed element circuit derived from a transfer function s21 of a lowpass prototype filter, the transfer function s21 being composed of a numerator rational polynomial f(s) and a denominator rational polynomial g(s), wherein the numerator rational polynomial f(s) is an even function of complex frequency s, f(s) has at least conjugate zeros on a real axis and at least conjugate zeros on an imaginary axis, and the denominator rational polynomial g(s) is a Hurwitz polynomial of degree 6 or higher of the complex frequency s, the distributed element circuit comprising:

a multiple coupling circuit block including:

first to fourth resonators;

a first coupling element for connecting the first resonator in cascade with a first external resonator located outward of the first resonator;

a second coupling element for connecting the first resonator and the second resonator in cascade;

a third coupling element for connecting the second resonator and the third resonator in cascade;

a fourth coupling element for connecting the third resonator and the fourth resonator in cascade;

a fifth coupling element for connecting the fourth resonator in cascade with a second external resonator located outward of the fourth resonator;

a sixth coupling element for bridge-coupling a connection point between the first and second coupling elements and the first resonator with a connection point between the fourth and fifth coupling elements and the fourth resonator; and a seventh coupling element for bridge-coupling a connection point between the first coupling element and the first external resonator with a connection point between the fifth coupling element and the second external resonator, wherein the sixth coupling element is realized by magnetic field coupling and the seventh coupling element by electric field coupling and, of the first to fifth coupling elements, one or three or five coupling elements are realized by magnetic coupling and the others by electric field coupling.

5. The distributed element filter of any one of claim 3 to 6, wherein the distributed element filter has bandpass characteristics realizing both a flat amplitude characteristic and a flat group delay characteristic throughout a passband thereof at the same time, while realizing transmission zeros in stopbands thereof.

6. The distributed element filter of any one of claim 3 to 6, wherein the multiple resonator filter is composed of distributed element circuit elements formed as a conductive pattern on a dielectric substrate.

7. The distributed element filter of any one of claim 3 to 6, wherein the first and second external resonators are parallel circuits or series circuits having an inductor and a capacitor.

* * * * *